US006282393B1

(12) United States Patent
Fujita

(10) Patent No.: US 6,282,393 B1
(45) **Date of Patent: *Aug. 28, 2001**

(54) DEVELOPING APPARATUS WITH ALTERNATING BIAS VOLTAGE

(75) Inventor: Hideki Fujita, Mishima (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 68 days.

(21) Appl. No.: 09/487,316

(22) Filed: Jan. 19, 2000

(30) Foreign Application Priority Data

Jan. 20, 1999 (JP) ..... 11-012373

(51) Int. Cl.[7] ..... G03G 15/06; G03G 15/09
(52) U.S. Cl. ..... 399/270; 430/122
(58) Field of Search ..... 399/55, 270, 285; 430/120, 122

(56) References Cited

U.S. PATENT DOCUMENTS 4,499,169 * 2/1985 Haneda et al. ..... 430/122 X
4,610,531 * 9/1986 Hayashi et al. ..... 399/270
4,797,335 * 1/1989 Hiratsuka et al. ..... 430/122 X
5,678,130 * 10/1997 Enomoto et al. ..... 399/55
5,697,010 12/1997 Masuda et al. ..... 399/46
5,753,398 5/1998 Mizoguchi ..... 430/102

FOREIGN PATENT DOCUMENTS 59-187350 10/1984 (JP) .
61-269265 11/1986 (JP) .
62-287262 12/1987 (JP) .

* cited by examiner

*Primary Examiner*—Joan Pendegrass
(74) *Attorney, Agent, or Firm*—Fitzpatrick, Cella, Harper & Scinto

(57) ABSTRACT

A developing apparatus in which a voltage application means which applies a voltage varying with a cycle T between a first voltage value and a second voltage value, and a transition time T1 from the first voltage value to the second voltage value and a transition time T2 from the second voltage value to the first voltage value satisfy:

$0.3T<T1<0.5T$ and $T2<0.1T$.

18 Claims, 16 Drawing Sheets

FIG. 16

| | η | A (V) | Vm (V) | f (kHz) | T (μs) | T1 (μs) | T1/T | T2 (μs) | T2/T | G (μm) | Vd (V) | Vl (V) | Edev (MV/m) | Edef+ (MV/m) | Dls (μm) | Dps (μm) | Dls/Dps | Dlm (μm) | ΔDs (μm) | Dpx (μm) | ΔDs/Dpx |
|---|---|---|---|---|---|---|---|---|---|---|---|---|---|---|---|---|---|---|---|---|---|
| EMBODIMENT 1 | 0.5 | 1100 | 200 | 2.7 | 370 | 141 | 0.38 | 10 | 0.03 | 180 | 450 | 50 | 4.44 | 3.89 | 66 | 42 | 1.57 | 55 | 11 | 42 | 0.26 |
| EMBODIMENT 2 | 0.5 | 900 | 200 | 2.7 | 370 | 141 | 0.38 | 10 | 0.03 | 160 | 450 | 50 | 4.38 | 3.75 | 66 | 42 | 1.57 | 55 | 11 | 42 | 0.26 |
| EMBODIMENT 3 | 0.5 | 700 | 200 | 2.7 | 370 | 141 | 0.38 | 10 | 0.03 | 140 | 450 | 50 | 4.29 | 3.57 | 66 | 42 | 1.57 | 55 | 11 | 42 | 0.26 |
| EMBODIMENT 4 | 0.5 | 1250 | 200 | 2.7 | 370 | 141 | 0.38 | 10 | 0.03 | 200 | 450 | 50 | 4.38 | 3.88 | 66 | 42 | 1.57 | 55 | 11 | 42 | 0.26 |
| EMBODIMENT 5 | 0.5 | 1500 | 200 | 2.7 | 370 | 141 | 0.38 | 10 | 0.03 | 230 | 450 | 50 | 4.35 | 3.91 | 66 | 42 | 1.57 | 55 | 11 | 42 | 0.26 |
| EMBODIMENT 6 | 0.5 | 1800 | 200 | 2.7 | 370 | 141 | 0.38 | 10 | 0.03 | 270 | 450 | 50 | 4.26 | 3.89 | 66 | 42 | 1.57 | 55 | 11 | 42 | 0.26 |
| EMBODIMENT 7 | 0.5 | 2100 | 200 | 2.7 | 370 | 141 | 0.38 | 10 | 0.03 | 300 | 450 | 50 | 4.33 | 4.00 | 66 | 42 | 1.57 | 55 | 11 | 42 | 0.26 |
| EMBODIMENT 8 | 0.5 | 900 | 200 | 2 | 500 | 190 | 0.38 | 10 | 0.02 | 180 | 450 | 50 | 3.89 | 3.33 | 66 | 42 | 1.57 | 55 | 11 | 42 | 0.26 |
| EMBODIMENT 9 | 0.5 | 1150 | 200 | 3 | 333 | 127 | 0.38 | 10 | 0.03 | 180 | 450 | 50 | 4.58 | 4.03 | 66 | 42 | 1.57 | 55 | 11 | 42 | 0.26 |
| EMBODIMENT 10 | 0.5 | 1200 | 200 | 3.3 | 303 | 114 | 0.38 | 10 | 0.03 | 180 | 450 | 50 | 4.72 | 4.17 | 66 | 42 | 1.57 | 55 | 11 | 42 | 0.26 |
| EMBODIMENT 11 | 0.5 | 1250 | 200 | 3.5 | 286 | 108 | 0.38 | 10 | 0.04 | 180 | 450 | 50 | 4.86 | 4.31 | 66 | 42 | 1.57 | 55 | 11 | 42 | 0.26 |
| EMBODIMENT 12 | 0.5 | 1300 | 200 | 4 | 250 | 95 | 0.38 | 10 | 0.04 | 180 | 450 | 50 | 5.00 | 4.44 | 66 | 42 | 1.57 | 55 | 11 | 42 | 0.26 |
| EMBODIMENT 13 | 0.5 | 1100 | 200 | 2.7 | 370 | 180 | 0.49 | 10 | 0.03 | 180 | 400 | 50 | 4.17 | 3.89 | 85 | 64 | 1.33 | 55 | 30 | 64 | 0.47 |
| EMBODIMENT 14 | 0.5 | 1100 | 200 | 2.7 | 370 | 141 | 0.38 | 10 | 0.03 | 180 | 400 | 50 | 4.17 | 3.89 | 90 | 64 | 1.41 | 57 | 33 | 64 | 0.52 |
| EMBODIMENT 15 | 0.5 | 1100 | 200 | 2.7 | 370 | 141 | 0.38 | 10 | 0.03 | 180 | 400 | 50 | 4.17 | 3.89 | 90 | 64 | 1.41 | 65 | 25 | 64 | 0.39 |
| EMBODIMENT 16 | 0.5 | 1100 | 200 | 2.7 | 370 | 141 | 0.38 | 10 | 0.03 | 180 | 400 | 50 | 4.17 | 3.89 | 90 | 64 | 1.41 | 80 | 10 | 64 | 0.16 |
| EMBODIMENT 17 | 0.5 | 1100 | 200 | 2.7 | 370 | 141 | 0.38 | 10 | 0.03 | 180 | 450 | 50 | 4.44 | 3.89 | 75 | 64 | 1.17 | 55 | 20 | 64 | 0.31 |
| EMBODIMENT 18 | 0.5 | 1100 | 200 | 2.7 | 370 | 141 | 0.38 | 10 | 0.03 | 180 | 450 | 50 | 4.44 | 3.89 | 89 | 64 | 1.39 | 65 | 24 | 64 | 0.38 |
| EMBODIMENT 19 | 0.5 | 1100 | 200 | 2.7 | 370 | 141 | 0.38 | 10 | 0.03 | 180 | 450 | 50 | 4.44 | 3.89 | 88 | 64 | 1.38 | 80 | 8 | 64 | 0.13 |
| EMBODIMENT 20 | 0.5 | 1100 | 200 | 2.7 | 370 | 115 | 0.31 | 10 | 0.03 | 180 | 400 | 50 | 4.17 | 3.89 | 66 | 42 | 1.57 | 55 | 11 | 42 | 0.26 |
| EMBODIMENT 21 | 0.5 | 1100 | 200 | 2.7 | 370 | 141 | 0.38 | 35 | 0.09 | 180 | 400 | 50 | 4.17 | 3.89 | 66 | 42 | 1.57 | 55 | 11 | 42 | 0.26 |
| EMBODIMENT 22 | 0.5 | 1100 | 200 | 2.7 | 370 | 141 | 0.38 | 30 | 0.08 | 180 | 450 | 50 | 4.44 | 3.89 | 66 | 42 | 1.57 | 55 | 11 | 42 | 0.26 |
| EMBODIMENT 23 | 0.5 | 1100 | 200 | 2.7 | 370 | 141 | 0.38 | 25 | 0.07 | 180 | 450 | 50 | 4.44 | 3.89 | 66 | 42 | 1.57 | 55 | 11 | 42 | 0.26 |
| EMBODIMENT 24 | 0.5 | 1100 | 200 | 2.7 | 370 | 141 | 0.38 | 20 | 0.05 | 180 | 450 | 50 | 4.44 | 3.89 | 66 | 42 | 1.57 | 55 | 11 | 42 | 0.26 |

FIG. 17

| | η | A (V) | Vm (V) | f (kHz) | T (μs) | T1 (μs) | T1/T | T2 (μs) | T2/T | G (μm) | Vd (V) | Vl (V) | Edev (MV/m) | Edef+ (MV/m) | Dls (μm) | Dps (μm) | Dls/Dps | Dlm (μm) | ΔDs (μm) | Dpx (μm) | ΔDs/Dpx |
|---|---|---|---|---|---|---|---|---|---|---|---|---|---|---|---|---|---|---|---|---|---|
| COMPARATIVE EXAMPLE 1 | 0.5 | 1100 | 200 | 2.7 | 370 | 109 | 0.29 | 10 | 0.03 | 180 | 450 | 50 | 4.44 | 3.89 | 66 | 42 | 1.57 | 55 | 11 | 42 | 0.26 |
| COMPARATIVE EXAMPLE 2 | 0.5 | 1100 | 200 | 2.7 | 370 | 100 | 0.27 | 10 | 0.03 | 180 | 450 | 50 | 4.44 | 3.89 | 66 | 42 | 1.57 | 55 | 11 | 42 | 0.26 |
| COMPARATIVE EXAMPLE 3 | 0.5 | 1100 | 200 | 2.7 | 370 | 10 | 0.03 | 10 | 0.03 | 180 | 450 | 50 | 4.44 | 3.89 | 66 | 42 | 1.57 | 55 | 11 | 42 | 0.26 |
| COMPARATIVE EXAMPLE 4 | 0.5 | 1100 | 200 | 2.7 | 370 | 141 | 0.38 | 40 | 0.11 | 180 | 450 | 50 | 4.44 | 3.89 | 66 | 42 | 1.57 | 55 | 11 | 42 | 0.26 |
| COMPARATIVE EXAMPLE 5 | 0.5 | 1100 | 200 | 2.7 | 370 | 141 | 0.38 | 50 | 0.14 | 180 | 450 | 50 | 4.44 | 3.89 | 66 | 42 | 1.57 | 55 | 11 | 42 | 0.26 |
| COMPARATIVE EXAMPLE 6 | 0.5 | 830 | 200 | 2.7 | 370 | 141 | 0.38 | 10 | 0.03 | 180 | 450 | 50 | 3.69 | 3.14 | 66 | 42 | 1.57 | 55 | 11 | 42 | 0.26 |
| COMPARATIVE EXAMPLE 7 | 0.5 | 800 | 200 | 2.7 | 370 | 141 | 0.38 | 10 | 0.03 | 180 | 450 | 50 | 3.61 | 3.06 | 66 | 42 | 1.57 | 55 | 11 | 42 | 0.26 |
| COMPARATIVE EXAMPLE 8 | 0.5 | 750 | 200 | 2.7 | 370 | 141 | 0.38 | 10 | 0.03 | 180 | 450 | 50 | 3.47 | 2.92 | 66 | 42 | 1.57 | 55 | 11 | 42 | 0.26 |
| COMPARATIVE EXAMPLE 9 | 0.5 | 1375 | 200 | 2.7 | 370 | 141 | 0.38 | 10 | 0.03 | 180 | 450 | 50 | 5.21 | 4.65 | 66 | 42 | 1.57 | 55 | 11 | 42 | 0.26 |
| COMPARATIVE EXAMPLE 10 | 0.5 | 1160 | 200 | 2.7 | 370 | 141 | 0.38 | 10 | 0.03 | 140 | 300 | 50 | 4.86 | 5.21 | 66 | 42 | 1.57 | 55 | 11 | 42 | 0.26 |
| COMPARATIVE EXAMPLE 11 | 0.5 | 1100 | 200 | 4.1 | 244 | 93 | 0.38 | 7 | 0.03 | 180 | 450 | 50 | 4.44 | 3.89 | 66 | 42 | 1.57 | 55 | 11 | 42 | 0.26 |
| COMPARATIVE EXAMPLE 12 | 0.5 | 1100 | 200 | 4.5 | 222 | 84 | 0.38 | 7 | 0.03 | 180 | 450 | 50 | 4.44 | 3.89 | 66 | 42 | 1.57 | 55 | 11 | 42 | 0.26 |
| COMPARATIVE EXAMPLE 13 | 0.5 | 1100 | 200 | 1.65 | 606 | 230 | 0.38 | 20 | 0.03 | 180 | 450 | 50 | 4.44 | 3.89 | 66 | 42 | 1.57 | 55 | 11 | 42 | 0.26 |
| COMPARATIVE EXAMPLE 14 | 0.5 | 1100 | 200 | 1.5 | 667 | 253 | 0.38 | 20 | 0.03 | 180 | 450 | 50 | 4.44 | 3.89 | 66 | 42 | 1.57 | 55 | 11 | 42 | 0.26 |
| COMPARATIVE EXAMPLE 15 | 0.5 | 1100 | 200 | 1.2 | 833 | 317 | 0.38 | 25 | 0.03 | 180 | 450 | 50 | 4.44 | 3.89 | 66 | 42 | 1.57 | 55 | 11 | 42 | 0.26 |
| COMPARATIVE EXAMPLE 16 | 0.3 | 750 | 200 | 2.7 | 370 | 10 | 0.03 | 10 | 0.03 | 180 | 450 | 50 | 4.31 | 2.08 | 66 | 42 | 1.57 | 55 | 11 | 42 | 0.26 |
| COMPARATIVE EXAMPLE 17 | 0.3 | 900 | 200 | 2.7 | 370 | 10 | 0.03 | 10 | 0.03 | 200 | 450 | 50 | 4.40 | 2.10 | 66 | 42 | 1.57 | 55 | 11 | 42 | 0.26 |
| COMPARATIVE EXAMPLE 18 | 0.3 | 1350 | 200 | 2.7 | 370 | 10 | 0.03 | 10 | 0.03 | 270 | 450 | 50 | 4.43 | 2.06 | 66 | 42 | 1.57 | 55 | 11 | 42 | 0.26 |

FIG. 18A

| | RD | FOG (%) | WIDTH OF VERTICAL LINE(μm) | WIDTH OF LATERAL LINE(μm) | DIFFERENCE OF WIDTH BETWEEN VERTICAL LINE AND LATERAL LINE ΔWl (μm) | DEVELOPING BIAS LEAK | IMAGE UNIFORMITY IN MINUTE AREA | REPRODUCTIVITY OF MINUTE PIXEL | RELATIVE VALUE OF APPARATUS COST |
|---|---|---|---|---|---|---|---|---|---|
| EMBODIMENT 1 | 1.45 | 0.9 | 183 | 170 | 13 | ABSENT | EXCELLENT | GOOD | 1 |
| EMBODIMENT 2 | 1.4 | 1.2 | 180 | 169 | 11 | ABSENT | EXCELLENT | GOOD | 0.99 |
| EMBODIMENT 3 | 1.34 | 1.1 | 178 | 172 | 6 | ABSENT | EXCELLENT | AVERAGE | 0.96 |
| EMBODIMENT 4 | 1.41 | 0.9 | 181 | 171 | 5 | ABSENT | EXCELLENT | GOOD | 1.01 |
| EMBODIMENT 5 | 1.43 | 1.2 | 180 | 172 | 8 | ABSENT | EXCELLENT | EXCELLENT | 1.02 |
| EMBODIMENT 6 | 1.41 | 1.5 | 180 | 171 | 9 | ABSENT | GOOD | GOOD | 1.03 |
| EMBODIMENT 7 | 1.44 | 1.6 | 185 | 179 | 6 | ABSENT | GOOD | GOOD | 1.04 |
| EMBODIMENT 8 | 1.32 | 0.5 | 175 | 168 | 7 | ABSENT | GOOD | GOOD | 1 |
| EMBODIMENT 9 | 1.39 | 0.8 | 180 | 175 | 5 | ABSENT | GOOD | GOOD | 1 |
| EMBODIMENT 10 | 1.38 | 0.7 | 178 | 170 | 8 | ABSENT | GOOD | GOOD | 1 |
| EMBODIMENT 11 | 1.38 | 0.5 | 176 | 171 | 5 | ABSENT | GOOD | GOOD | 0.99 |
| EMBODIMENT 12 | 1.32 | 0.4 | 173 | 168 | 5 | ABSENT | GOOD | AVERAGE | 0.98 |
| EMBODIMENT 13 | 1.36 | 0.9 | 288 | 258 | 30 | ABSENT | EXCELLENT | AVERAGE | 0.95 |
| EMBODIMENT 14 | 1.36 | 1.5 | 286 | 253 | 33 | ABSENT | EXCELLENT | AVERAGE | 0.95 |
| EMBODIMENT 15 | 1.36 | 1 | 278 | 253 | 25 | ABSENT | EXCELLENT | AVERAGE | 0.95 |
| EMBODIMENT 16 | 1.35 | 0.7 | 263 | 253 | 10 | ABSENT | EXCELLENT | AVERAGE | 0.95 |
| EMBODIMENT 17 | 1.42 | 0.9 | 288 | 268 | 20 | ABSENT | GOOD | AVERAGE | 0.95 |
| EMBODIMENT 18 | 1.39 | 0.5 | 278 | 254 | 24 | ABSENT | AVERAGE | AVERAGE | 0.95 |
| EMBODIMENT 19 | 1.41 | 0.5 | 263 | 255 | 8 | ABSENT | EXCELLENT | AVERAGE | 0.95 |
| EMBODIMENT 20 | 1.32 | 0.5 | 175 | 168 | 7 | ABSENT | GOOD | GOOD | 0.98 |
| EMBODIMENT 21 | 1.33 | 1.5 | 165 | 164 | 1 | ABSENT | GOOD | AVERAGE | 0.94 |
| EMBODIMENT 22 | 1.35 | 1.6 | 169 | 170 | 1 | ABSENT | GOOD | AVERAGE | 0.94 |
| EMBODIMENT 23 | 1.35 | 1.4 | 171 | 172 | 1 | ABSENT | GOOD | AVERAGE | 0.95 |
| EMBODIMENT 24 | 1.32 | 1.2 | 166 | 166 | 0 | ABSENT | GOOD | AVERAGE | 0.95 |

FIG. 18B

| | RD | FOG (%) | WIDTH OF VERTICAL LINE(μm) | WIDTH OF LATERAL LINE(μm) | DIFFERENCE OF WIDTH BETWEEN VERTICAL LINE AND LATERAL LINE ΔWl (μm) | DEVELOPING BIAS LEAK | IMAGE UNIFORMITY IN MINUTE AREA | REPRODUCTIVITY OF MINUTE PIXEL | RELATIVE VALUE OF APPARATUS COST |
|---|---|---|---|---|---|---|---|---|---|
| COMPARATIVE EXAMPLE 1 | 1.4 | 2.2 | 165 | 160 | 5 | ABSENT | AVERAGE | GOOD | 0.98 |
| COMPARATIVE EXAMPLE 2 | 1.42 | 2 | 161 | 160 | 1 | ABSENT | AVERAGE | GOOD | 0.98 |
| COMPARATIVE EXAMPLE 3 | 1.37 | 1.8 | 152 | 150 | 2 | ABSENT | AVERAGE | GOOD | 0.98 |
| COMPARATIVE EXAMPLE 4 | 1.21 | 0.9 | 157 | 155 | 2 | ABSENT | AVERAGE | GOOD | 0.97 |
| COMPARATIVE EXAMPLE 5 | 1.22 | 0.5 | 162 | 160 | 2 | ABSENT | AVERAGE | GOOD | 0.97 |
| COMPARATIVE EXAMPLE 6 | 1.28 | 1 | 160 | 150 | 10 | ABSENT | AVERAGE | GOOD | 1 |
| COMPARATIVE EXAMPLE 7 | 1.26 | 1.1 | 165 | 155 | 10 | ABSENT | AVERAGE | GOOD | 1 |
| COMPARATIVE EXAMPLE 8 | 1.21 | 1.7 | 160 | 155 | 5 | ABSENT | AVERAGE | GOOD | 1 |
| COMPARATIVE EXAMPLE 9 | 1.41 | 2.5 | 175 | 170 | 5 | PRESENT | AVERAGE | GOOD | 1.03 |
| COMPARATIVE EXAMPLE 10 | 1.45 | 1.3 | 178 | 175 | 3 | PRESENT | AVERAGE | AVERAGE | 1 |
| COMPARATIVE EXAMPLE 11 | 1.42 | 0.7 | 155 | 155 | 5 | ABSENT | AVERAGE | GOOD | 1.06 |
| COMPARATIVE EXAMPLE 12 | 1.39 | 0.2 | 160 | 157 | 3 | ABSENT | AVERAGE | GOOD | 1.1 |
| COMPARATIVE EXAMPLE 13 | 1.42 | 2.1 | 172 | 165 | 7 | ABSENT | AVERAGE | GOOD | 0.96 |
| COMPARATIVE EXAMPLE 14 | 1.43 | 2.5 | 180 | 175 | 5 | ABSENT | AVERAGE | GOOD | 0.96 |
| COMPARATIVE EXAMPLE 15 | 1.41 | 2.3 | 185 | 175 | 10 | ABSENT | AVERAGE | GOOD | 0.95 |
| COMPARATIVE EXAMPLE 16 | 1.41 | 2.2 | 175 | 160 | 15 | ABSENT | EXCELLENT | GOOD | 0.99 |
| COMPARATIVE EXAMPLE 17 | 1.41 | 2.5 | 175 | 160 | 15 | ABSENT | EXCELLENT | GOOD | 0.99 |
| COMPARATIVE EXAMPLE 18 | 1.41 | 2.4 | 185 | 174 | 11 | ABSENT | EXCELLENT | GOOD | 0.99 |

DEVELOPING APPARATUS WITH ALTERNATING BIAS VOLTAGE

BACKGROUND OF THE INVENTION

1. Field of the Invention

The present invention relates to an image forming apparatus capable of forming a latent image on a latent image bearing means by means of an exposure means and a developing apparatus employed therein, and more particularly to a copying apparatus, a printing apparatus, a facsimile apparatus or the like of the BAE system to be explained later, equipped with an amorphous silicon photosensitive member as the electrostatic latent image bearing member.

2. Related Background Art

The image forming apparatus of a digital system forms the image by a process to be explained in the following. FIG. 1 is a schematic cross-sectional view of such image forming apparatus.

A drum-shaped photosensitive member 1, constituting an electrostatic latent image bearing means, is uniformly charged with a primary charging means 3 at a potential Vdpre (V). A laser beam B, induced by a laser driver circuit 81, is directed on an unrepresented rotary polygon mirror, called a polygon scanner. The beam B reflected from the rotary polygon mirror irradiates the surface of the electrostatic latent image bearing means 1, displaced at a constant velocity Vprs. By the rotation of the rotary polygon mirror, the laser beam B scans the photosensitive drum 1 in a direction A of movement of the photosensitive drum 1 (hereinafter called subscanning direction) and a perpendicular direction K (hereinafter called main-scanning direction) (cf. FIG. 12). The laser beam B is turned on and off according to the image to be outputted, thereby forming an electrostatic latent image on the photosensitive drum 1, and such electrostatic latent image is developed into a visible toner image.

The toner image is transferred by transfer means 5 onto a transfer material M, which is then separated by separation means 6 from the electrostatic latent image bearing means 1 and the toner image is fixed onto the transfer material M by unrepresented fixing means to obtain the final print output. The toner T' not transferred onto the transfer material M but remaining on the electrostatic latent image bearing means is removed by a cleaning means 7.

In the first place, in order to obtain a clear image without fog or the like, the toner is required to have an appropriate electrostatic charge. The toner is also required to be free from changes such as significant attenuation of the charge amount or solidification caused by a secular change or an environmental change such as change in humidity. This is because an attenuation of the charge amount from the initially set value results in various drawbacks such as a decrease in the image density, an increase in toner scattering leading to background fog or toner scattering on the white image area, and smearing with toner around the developing means 4.

In order to meet the above-mentioned requirements, the addition of a charge controlling agent is almost essential in manufacturing toner, but, with the recent increase of color image formation, there is required a charge control agent of a white or pale yellow color in order to achieve satisfactory color reproducing ability.

Among the negative charge control agents for providing a negative charge, the colorless, white-color and pale yellow-colored ones are already commercially available with satisfactory performance and can therefore be adopted without any practical limitation. On the other hand, for the positive charge control agents for providing a positive charge, particularly those suitable for use in colored toner, there are only known nigrosin dyes as colored ones and quaternary ammonium salts or imidazole compounds (Japanese Patent Application Laid-open Nos. 62-287262, 61-269265 and 59-187350) as colorless ones and they are quite limited in their kinds.

The nigrosin dye is not composed of a pure compound but of a mixture of several compounds with an unidentified composition, so that a constant performance cannot be expected. Also the nigrosin dye is effective for giving a stable charge to the toner for use in a copying apparatus of a low or medium transfer speed, but cannot exhibit such function in the toner composed of a low melting point and a low viscosity for a high-speed copying apparatus. Also the nigrosin dyes, being colored, are not suitable for use in the colored toners.

The quaternary ammonium salts have various drawbacks such as an environmental instability of the charging ability, a large particle size prohibiting the fusion at the fixing operation and an unpleasant small. Also the quaternary ammonium salts are unsatisfactory in the charging ability, like the nigrosin dyes.

Thus the positive charge control agents for providing a positive charge are limited in the kinds, and are particularly limited in colorless or white-colored ones usable for the color toners. Consequently the negatively charged toner has to be considered to have a larger freedom at present, and in practice such negative charged toner is widely employed in the high-speed image forming apparatus.

On the other hand, in the photosensitive drums, organic photoconductors (hereinafter represented as OPC) are widely employed because of a lower manufacturing cost and absence of toxicity.

However the OPC shows fast abrasion and a nonlinear relationship between the exposure energy Eexp and the photosensitive drum potential Vs as shown in FIG. 13, whereby the potential sags at the edge portion of the image, resulting in thinning of the image lines in the BAE system.

Also the OPC is associated with the significant deterioration of the charging characteristics and the exposure characteristics with the repetition of the image outputs (FIG. 14), wherein a indicates the deterioration of the charging characteristics (potential decrease in the dark image area) and b indicates the deterioration of the photosensitive characteristics (potential increase in the light image area).

It will be understood that the development contrast Vcdev, which is initially 500 (V), is reduced to 300 (V) at the end. It is already known that such a decrease in the development contrast Vcdev results in a decrease in the developed toner amount, and also in thinning of the image lines.

On the other hand, the electrostatic latent image bearing means consisting of amorphous silicon (hereinafter represented as a-Si), though higher in the manufacturing cost, can form the latent image relatively faithful to the distribution of the exposure energy, so that the image quality is not much different between the IAE and BAE systems. Also because of the drastically higher durability, the cost per print eventually becomes lower, so that such latent image bearing means is ideal for the high-speed image forming apparatus.

In forming digital electrostatic latent image, there are known the following two systems.

The first system, IAE (image area exposure) system for effecting laser exposure in the dark image area, is widely employed in the digital copying apparatus, printers etc. utilizing the laser beam for latent image formation.

In the IAE system, the potential V1 of the light image area (white area) and the potential Vd of the dark image area (black area) satisfy a relationship |Vd|>|V1|, and the toner image is formed by reversal development in the developing means with toner charged with a polarity same as that of the electrostatic latent image bearing means, under a developing bias of an average value Vm.

The second system, BAE (background area exposure) for effecting laser exposure in the light image area (white area), is widely employed in the analog image forming apparatus such a copying apparatus.

In the BAE system, then potential V1 of the light image area (white area) and the potential Vd of the dark image area (black area) satisfy a relationship |Vd|>|V1|, and the toner image is formed by normal development in the developing means with toner charged in a polarity opposite to that of the electrostatic latent image bearing means, under a developing bias of an average value Vm.

The BAE system can be realized also in the digital manner, besides in the analog manner, by reducing the absolute value of the potential in the white area other than the image information area, for example with a laser beam.

Consequently, in the high-speed image forming apparatus, the combination of the negatively charged toner and the a-Si based electrostatic latent image bearing means is ideal.

Such image forming apparatus inevitably utilizes the latent image formation by the BAE system. However, the intensity distribution of the laser beam scanning the surface of the electrostatic latent image bearing means 1 is not completely rectangular, as indicated by a broken line in FIG. 8, but shows a Gaussian distribution as indicated by a solid line, so that, in the laser exposure in the BAE system, the light spot at the boundary of a dark area and a light area spreads into the dark image area (black area). As a result, in a fine line image or in fine image spots, the electrostatic latent image becomes finer than the actual image information, so that the toner image after image development cannot is faithful to the image information.

Also if the background contrast potential Vcbg, which is the difference between the average developing bias Vm and the light potential V1 of the electrostatic latent image bearing means, is small, the insufficiently charged toner tends to be deposited in the area where the charge is not completely dissipated between the sub scanning lines (FIG. 15). Consequently, in order to reproduce a fine line, the spot diameter has to be sufficiently small, and the contrast between the dark potential and the light potential inevitably becomes smaller even if the striped fog in the sub scanning direction becomes less conspicuous, so that the density of the solid black area is lowered. Such image development becomes more conspicuous as the resolution of the latent image is elevated.

SUMMARY OF THE INVENTION

An object of the present invention is to provide a developing apparatus and an image forming apparatus, capable of providing stable image output.

Another object of the present invention is to provide an image forming apparatus capable of maintaining a constant width of the line image and providing a stable image output with reduced background fog, regardless of the number of repetitions of the image output.

Still another object of the present invention is to provide a developing apparatus comprising:

a developer bearing member for bearing developer; and voltage application means for applying a voltage to the developer bearing member, the voltage application means being adapted to apply a voltage varying with a cycle T between a first voltage value for separating the developer from the developer bearing member and a second voltage value for returning the developer to the developer bearing member;

wherein a transition time T1 from the first voltage value to the second voltage and a transition time T2 from the second voltage value to the first voltage satisfy:

$0.3T<T1<0.5T$ and $T2<0.1T$.

Still another object of the present invention is to provide an image forming apparatus comprising:

a latent image bearing member for bearing a latent image;

a developer bearing member provided to the latent image bearing member with a gap and adapted for bearing developer; and voltage application means for applying a voltage to the developer bearing member, the voltage application means being adapted to apply a voltage varying with a cycle T between a first voltage value for separating the developer from the developer bearing member and a second voltage value for returning the developer to the developer bearing member;

wherein a transition time T1 from the first voltage value to the second voltage and a transition time T2 from the second voltage value to the first voltage satisfy:

$0.3T<T1<0.5T$ and $T2<0.1T$.

Still other objects of the present invention, and the features thereof, will become fully apparent from the following detailed description, which is to be taken in conjunction with the attached drawings.

BRIEF DESCRIPTION OF THE DRAWINGS

FIG. 1 is a view showing the principal portions of an image forming apparatus constituting an embodiment 1 and so on;

FIG. 3 is a view showing developing means employed in the embodiment 1 and so on;

FIG. 5 is a chart showing the waveform of developing bias in the embodiment 1 and so on;

FIG. 16 is a table showing the set values of the developing bias etc. in embodiments 1 to 24;

FIG. 17 is a table showing the set values of the developing bias etc. in comparative examples 1 to 18; and FIGS. 18A and 18B are tables showing the result and evaluation of the image output in the embodiments and comparative examples.

DESCRIPTION OF THE PREFERRED EMBODIMENTS

The present invention will now be explained in detail by embodiments thereof, with reference to the attached drawings.

In the image forming apparatus embodying the present invention, components similar to those already explained in the prior art will not be explained further.

Embodiment 1

Figure 1:
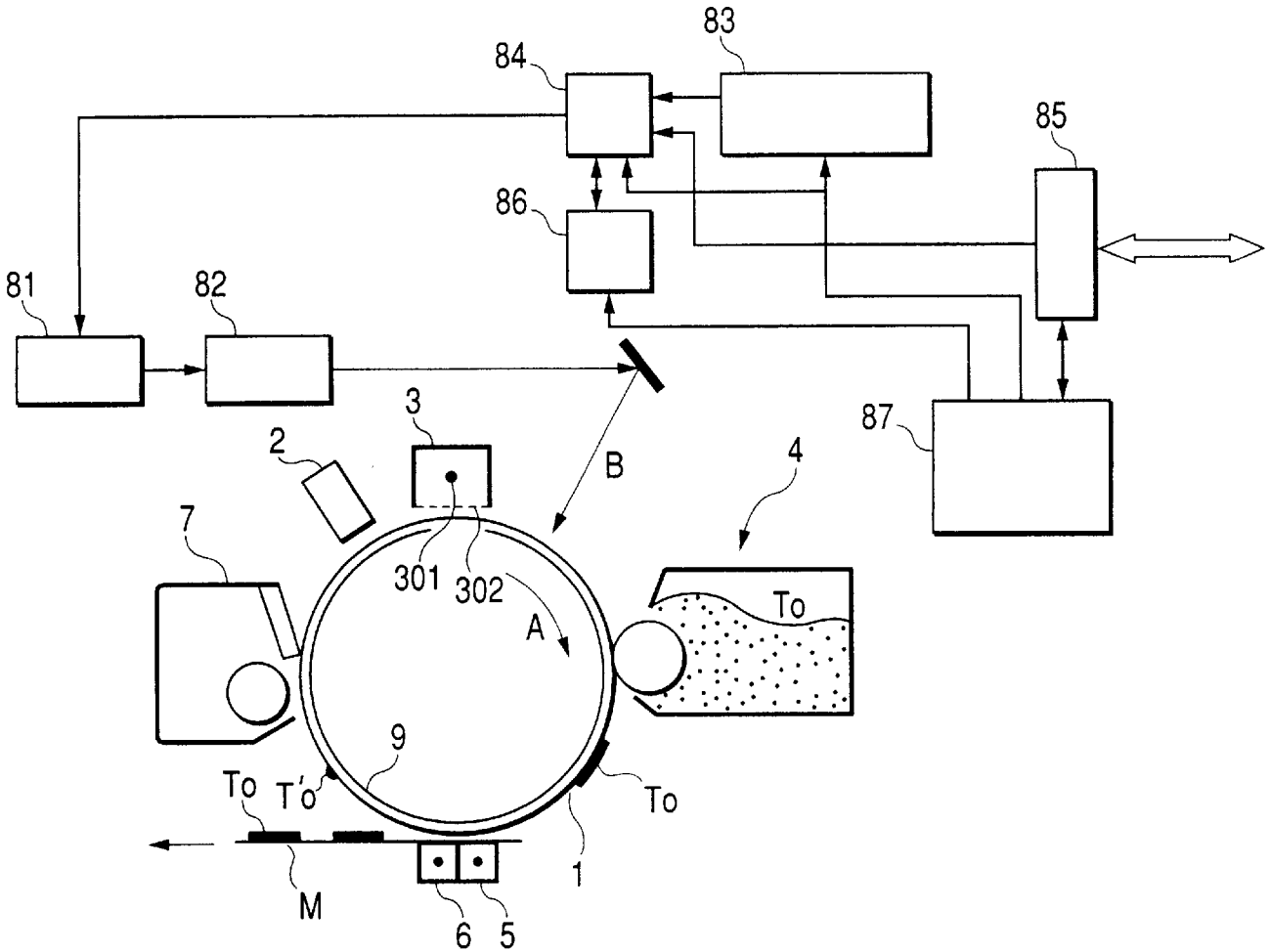

FIG. 1 is a view showing the principal portions of an image forming apparatus constituting an embodiment 1 of the present invention.

A drum-shaped photosensitive member or photosensitive drum 1 of a diameter of 80 mm constitutes the electrostatic latent image bearing means and utilizes a-Si in a photosensitive layer 101. The rotation speed of the photosensitive drum or the process speed is 265 mm/sec., corresponding to 60 sheets per minute in case of consecutively forming a same image on one side of the transfer materials of A4 size.

Figure 2:
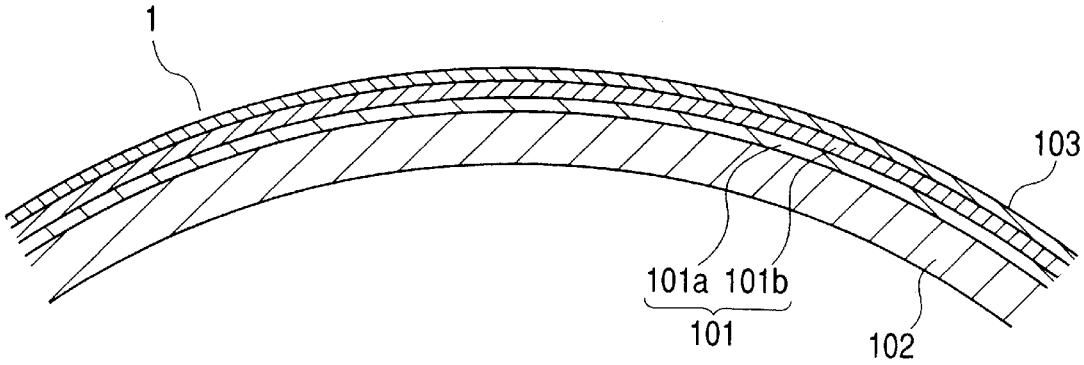
FIG. 2 is a cross-sectional view of a drum-shaped photosensitive member.

FIG. 2 is a schematic cross-sectional view showing the structure of the photosensitive drum.

Referring to FIG. 2, the photosensitive drum is composed of a conductive substrate 102 such as of aluminum, and a photosensitive layer 101 (a charge injection inhibition layer 101*a* and a photoconductive layer 101*b*) and a surface layer 103 deposited in succession on the conductive substrate 102. The charge injection inhibition layer 101*a* is to inhibit charge injection from the conductive substrate 102 to the photoconductive layer 101*b* and is provided if necessary. The photoconductive layer 101*b* is composed of an amorphous material containing at least silicon atoms, and shows photoconductivity. The surface layer 103 contains silicon atoms and carbon atoms (in addition hydrogen atoms and/or halogen atoms if necessary), and serves to support the visible image in the electrophotographic apparatus.

There are also provided pre-exposure means 2 including an LED emitting light of a wavelength of 660 nm for eliminating the retentive charge, primary charging means 3 of so-called scorotron type including a tungsten wire 301 as a charging electrode and a grid 302, and developing means 4 (FIG. 1).

Figure 4:
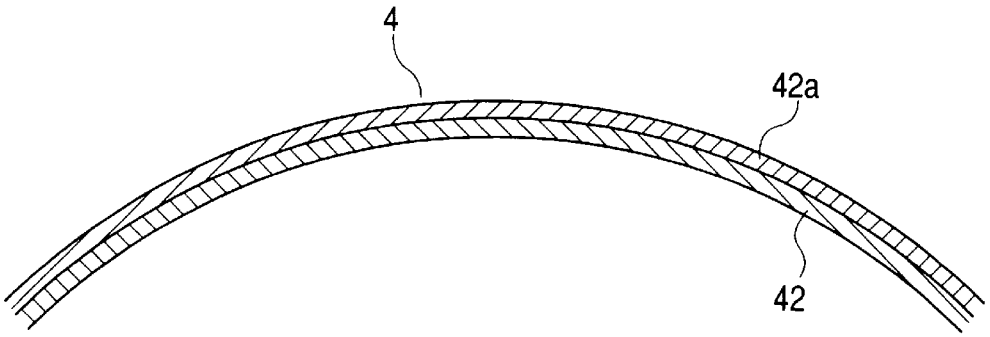
FIG. 4 is a cross-sectional view of a toner bearing member.
Figure 3:
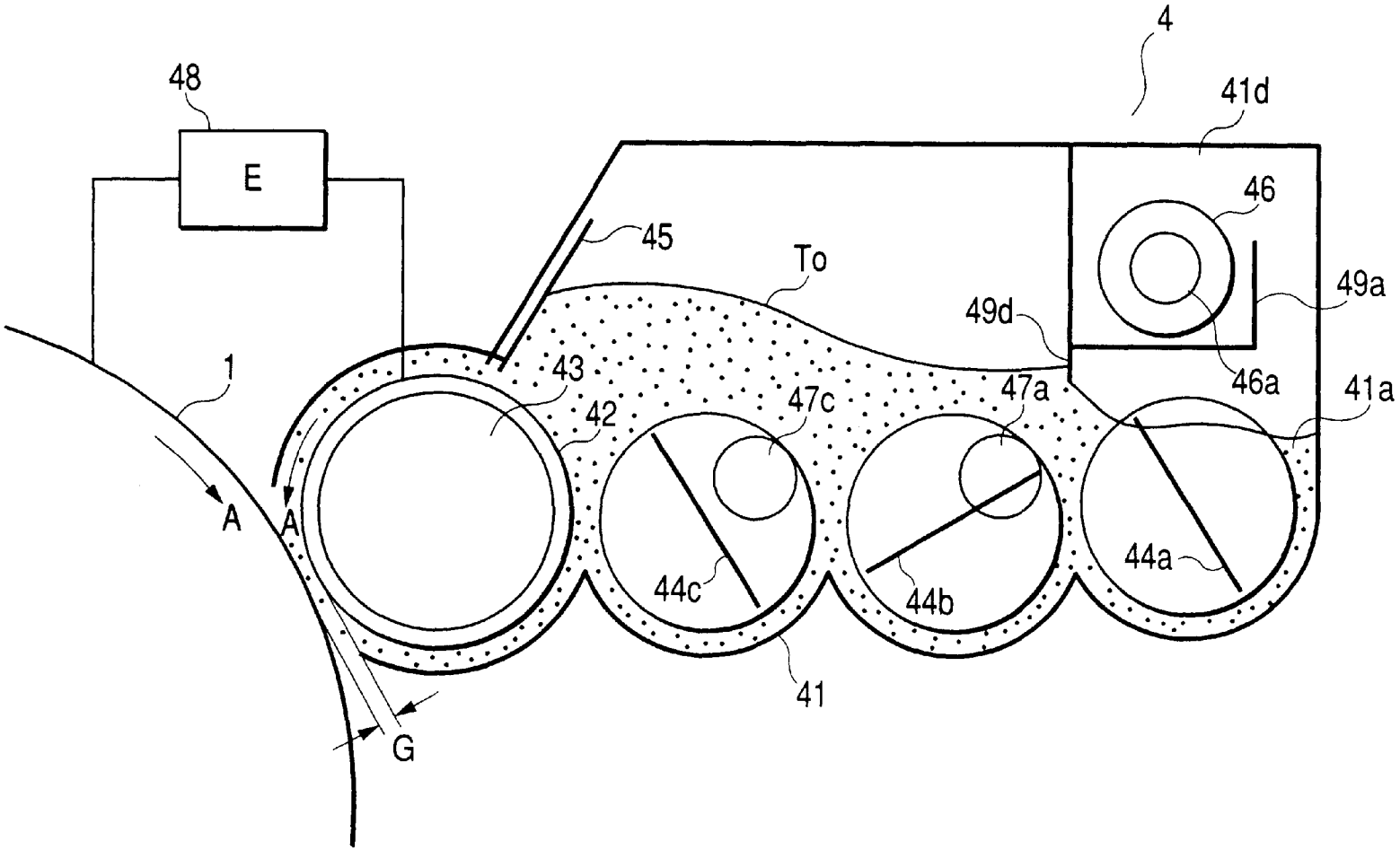

FIG. 3 illustrates the developing means 4 in the image forming apparatus of the embodiment 1 of the present invention. The developing means 4 is provided with a developing roller consisting of a cylindrical sleeve 42 of a diameter of 32.33 mm of an aluminum alloy (A6063) and a magnet roller 43 fixed therein and having six magnetic poles, and developing bias applying means 48. An external layer 42*a* of the sleeve 42 has a thickness of 10 to 14 μm and is composed of a resinous material such as phenolic resin in which conductive particles such as of carbon graphite are dispersed (FIG. 4). The sleeve 42 supports thereon toner To serving as the developer, is opposed to the photosensitive drum 1 with a gap G=180 μm thereto by means of unrepresented resinous spacer rollers, and is rotated at a speed of 390 mm/s by unrepresented drive means thereby transferring the toner to the image information area of the photosensitive drum 1. The gap G is preferably maintained not less than 140 μm and not more than 200 μm, since, if G is smaller than 140 μm, the minute vibration of the image forming apparatus influences the developing electric field, resulting in unevenness in the formed image.

Figure 5:
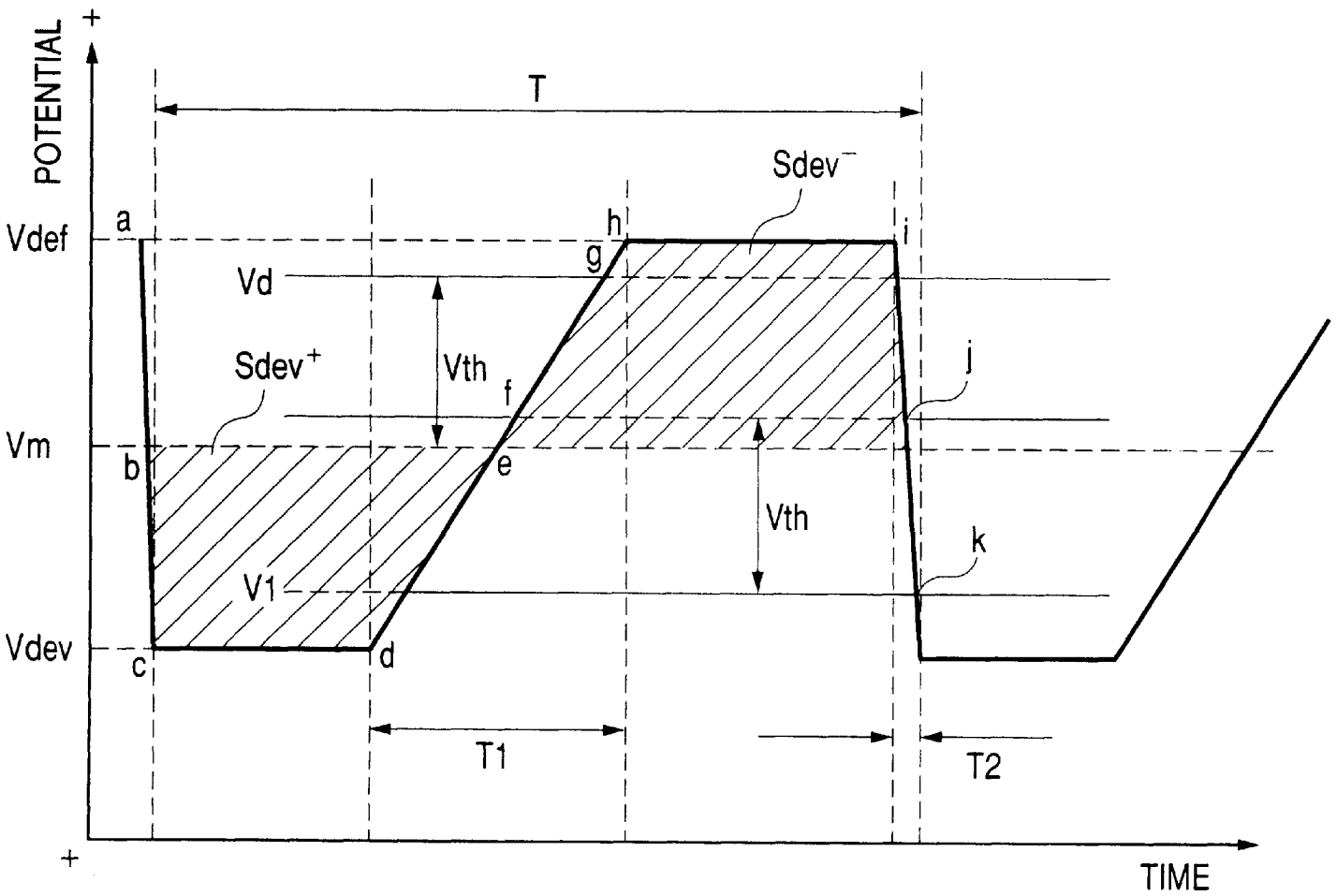

The developing bias applied to the sleeve has a "sloped" waveform as shown in FIG. 5, with a cycle time T of 370 μs, a frequency f (=1/T) of 2700 Hz, an amplitude A (=Vdef−Vdev) of 1100 V and an average voltage Vm of 180 to 220 V. The cycle time T is preferably selected to be not less than 250 μs and not more than 600 μs, since a cycle time shorter than 250 μs elevates the cost of the power source for the developing bias and deteriorates the reproducibility of small image dots after prolonged printing operation. Also the amplitude A is preferably selected to be equal to or lower than 2000 V, since an amplitude A larger than 2000 V elevates the cost of the power source for the developing bias.

In theory, the sloped bias provides a lower image density in comparison with the commonly employed rectangular bias, but is in fact comparable in the image density (FIGS. 18A and 18B) and is found to have various advantages such as reduced fog (in particular with the toner of the inverted charge polarity) and satisfactory image uniformity.

In the following discussion there will be explained the change of the developing bias in time series. At first the developing bias is shifted downwards from a point a to a point c, and the toner on the sleeve overcomes the reflection force from the sleeve and starts to transfer to the photosensitive member when the potential becomes lower than a point b where the potential difference from Vd becomes at least equal to a predetermined value Vth.

The development is executed under a potential Vdev of the development accelerating side between points c and d, corresponding to 25% of the cycle (cycle time), and the potential is shifted upwards from the point d.

Figure 6:
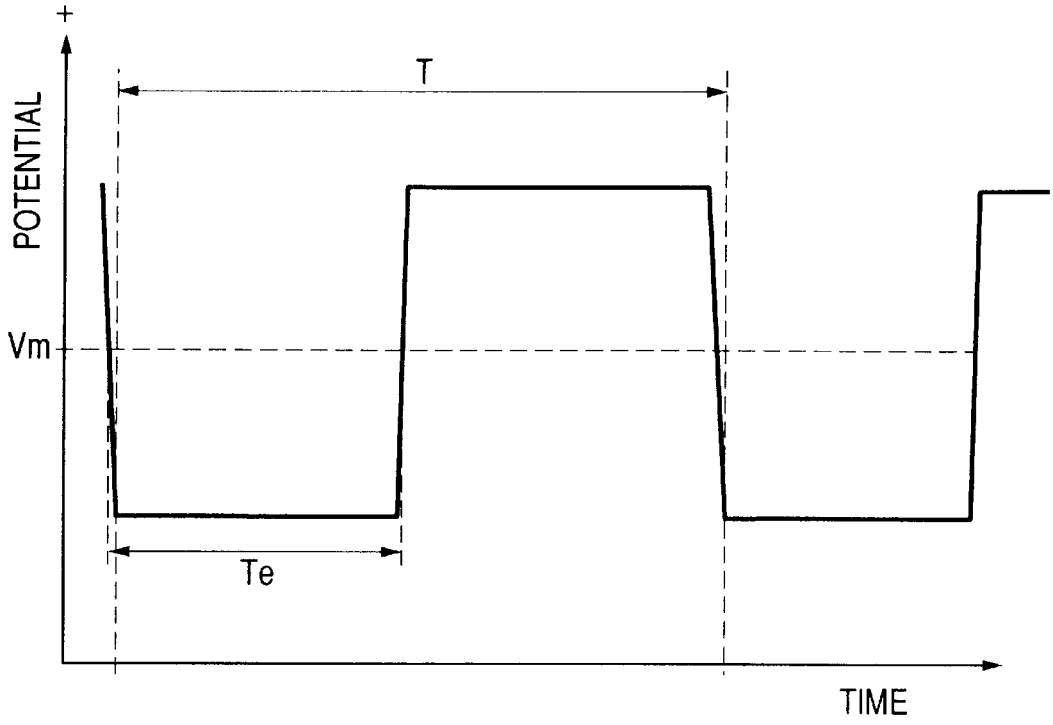
FIG. 6 is a chart showing the waveform of a rectangular wave employed as the developing bias.

The potential is shifted upwards so as to show a slow change to Vdef of the returning side. The conventional developing bias naturally has an upshift phase, which is selected as being about 10% of the cycle time in the ordinary rectangular wave as shown in FIG. 6. In the present invention, it is important to intentionally increase the upshift time in comparison with the ordinary rectangular wave, and, in the present embodiment, the upshift time is selected as 38% of the cycle.

At a point e corresponding to ½ of the cycle, the potential crosses the integrated DC value Vm of the AC component. The area Sdev+, defined by points bcde and executing development, is compared as 1.57/3.14/2.36 in the triangular wave/rectangular wave/sloped wave, so that the intensity of development can be larger in the sloped wave than in the triangular wave.

The developing bias is further shifted upwards to a point f, where the potential difference from V1 becomes at least equal to Vth and the oppositely charged toner starts to transfer to the VL area. Thereafter the developing bias is shifted through a point g to a point h at Vdef. In the period h to i, a returning force works on the normally charged toner whereby the toner excessively deposited in the Vd area is returned to the sleeve.

On the other hand, the oppositely charged toner executes development in the VL area.

The development bias is then shifted down again from the point i, and the above-described process is repeated.

The area Sdev−, defined by points fhij for executing development with the oppositely charged toner (namely area where the potential is higher than V1 at least by Vth), can be made securely smaller than in the case of the rectangular wave.

Such effect becomes more conspicuous as the sloped portion becomes less steep (namely as T1/T becomes larger), and decreases as the slope becomes steeper. For this reason there can be obtained an effect different from the case of the conventional rectangular wave in which the upshift time is about 10% of the cycle time.

In this manner the intensity of development is made larger than in the triangular wave and the intensity of reversal fog is made smaller than in the rectangular wave.

The normally charged toner starts to transfer to the photosensitive member by overcoming the reflection force of the sleeve at the point b, and executes development with a force approximately proportional to the area Sdev+ as explained in the foregoing. In the period e to f, the toner scarcely receives force, but the toner continues transfer by inertia to the photosensitive member (though the speed of transfer is attenuated by the resistance of the air and the collision of the toner particles) until the point g where the developing bias becomes higher than Vd to the returning side. Consequently the force serving for development is approximately proportional to the area Sdev+, but the toner transfer in the developing direction takes place in the period b to g.

Similarly the oppositely charged toner continues transfer to the VL area within a period from f to k where the developing bias becomes lower than V1. Thus the sloped bias, having a sloped portion in the returning side of the AC bias, can increase the developing time with the normally charged toner in excess of 50% of the cycle T, and decrease the time of development of the VL area with the oppositely charged toner less than 50% of the cycle T.

The image density is difficult to elevate because the area Sdev+ is smaller than in the case of rectangular wave, but can be made comparable to the case of rectangular wave by increasing the developing time b to g.

Also the reversal fog is easily generated because the area Sdev− is larger than in the case of triangular wave, but can be suppressed to the level of triangular wave, by decreasing the period f to k (reversal fog period).

As explained in the foregoing discussion, it is rendered possible, as shown in FIGS. 18A and 18B, to simultaneously suppress the low image density and the reversal fog which are respective drawbacks of the sine wave and the rectangular wave, by improving the rectangular wave so as to have a relatively large sloped portion in the developing AC bias to the returning side for the normally charged toner.

The transition time T1 can be selected within a range larger than 0.3 T but smaller than 0.5 T. The transition time T2 is preferably as close to 0 as possible, but can be selected in practice less than 0.1 T, in consideration of the cost of the power source for the developing bias (FIGS. 18A, 18B).

Figure 7:
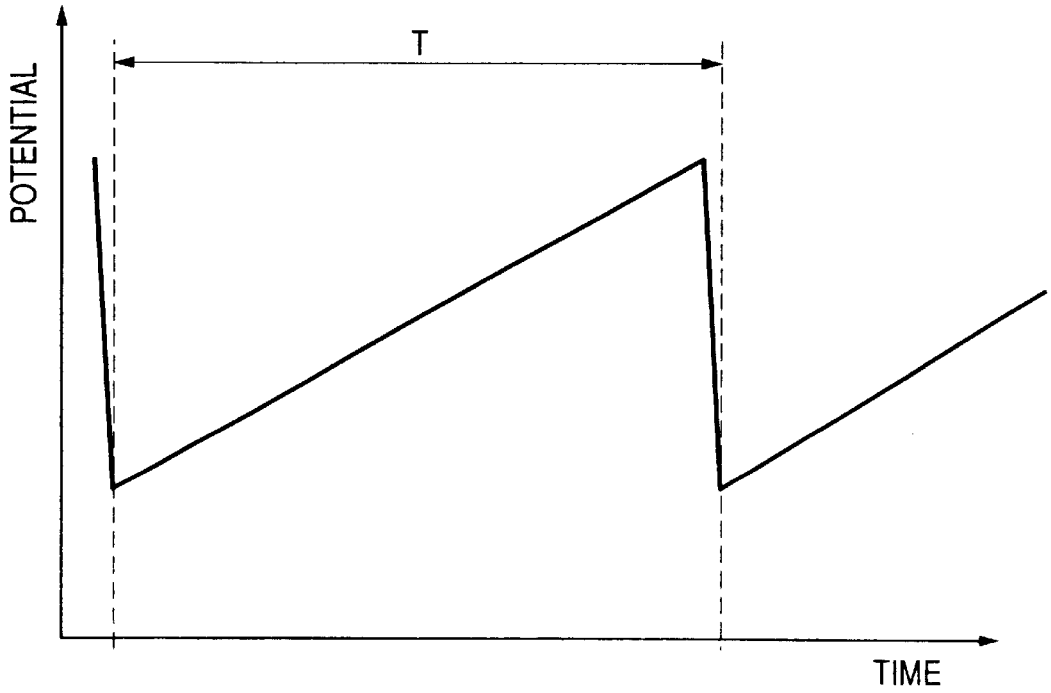
FIG. 7 is a chart showing the waveform of a triangular or sawtooth wave employed as the developing bias.

If the transition time T1 is equal to or less than 0.3 T, the obtained effect is similar to that of the rectangular wave (FIG. 6), and, if it is equal to or larger than 0.5 T, the image density becomes low (FIGS. 18A, 18B) as in the case of the triangular or sawtooth wave (FIG. 7).

In the present embodiment, the transition time T1 is selected as 141 μs and T2 as 10 μs, so as to satisfy $0.3T<T1<0.5T$ and $T2<0.1T$.

Also the electric field $|Vd-Vdev|/G$, in the toner transfer period from the sleeve to the drum, is preferably as large as possible, but it is found to be smaller than 5.2 V/μm in consideration of the cost of the bias source and the leakage in the low pressure environment and larger than 3.7 V/μm for obtaining a stable image density (FIGS. 18A, 18B).

In the present embodiment, Vd is selected in a range of 440 to 460 V while Vdev is selected in a range of −370 to −330 V, so that $|Vd-Vdev|/G$ is within a range of 4.28 to 4.88 V/μm, thus satisfying a condition:

$$3.7\ V/\mu m<|Vd-Vdev|/G<5.2\ V/\mu m.$$

Also the electric field $|Vdef-V1|/G$, in the toner transfer period from the drum to the sleeve, is preferably as large as possible, but it is found to be smaller than 5.2 V/μm in consideration of the cost of the bias source and the leakage in the low pressure environment and larger than 2.2 V/μm for suppressing the fog at a certain level (FIGS. 18A, 18B).

In the present embodiment, V1 is selected in a range of 40 to 60 V while Vdef is selected in a range of 730 to 770 V, so that $|Vdef-V1|/G$ is within a range of 3.72 to 4.06 V/μm, thus satisfying a condition:

$$2\ V/\mu m<|Vdef-V1|/G<5.2\ V/\mu m.$$

There is employed insulating magnetic one-component toner with an initial volume-averaged particle size D4 of 7.5 μm.

The particle size distribution of the toner can be measured in various methods, but is measured in the present invention with the Coulter Counter (trade name) TA-11 (supplied by Coulter Inc., U.S.) connected to an interface and a computer for obtaining the particle number distribution and volume distribution, employing 1% aqueous solution of NaCl as the electrolyte.

In 100 to 150 ml of the above-mentioned electrolyte solution, there are added a surfactant, preferably 0.1 to 5 ml of alkylbenzene sulfonic acid salt, as the dispersing agent and 2 to 20 mg of the specimen to be measured. The electrolyte in which the specimen is suspended is subjected to dispersing treatment for about 1 to 3 minutes in an ultrasonic disperser, and the average particle size D4 is calculated by measuring the particle size distribution of the particles of 2 to 40 μm based on the number of particles, utilizing the above-mentioned measuring instrument with an aperture of 100 μm.

As the binder resin of the toner, there can be employed homopolymer of styrene or substitutes thereof such as polystyrene, poly-p-chlorostyrene, polyvinyltoluene, styrenic copolymer such as styrene-p-chlorostyrene copolymer, styrene-vinyltoluene copolymer, styrene-vinylnaphthalene copolymer, styrene-acrylate ester copolymer, styrene-methyl α-chloromethacrylate copolymer, styrene-acrylonitrile copolymer, styrene-vinylmethylether copolymer, styrene-vinylmethylketone copolymer, styrene-butadiene copolymer, styrene-isoprene copolymer or styrene-acrylonitrile-indene copolymer, polyvinyl chloride, phenolic resin, natural resin-denatured maleic acid resin, acrylic resin, methacrylic resin, polyvinyl acetate, silicone resin, polyester resin, polyurethane, polyamide resin, furane resin, polyvinyl butyral, epoxy resin, xylene resin, polyvinyl butyral, terpene resin, coumarone-indene resin, petroleum resin etc.

The toner to be employed in the present invention is prepared by mixing a coloring agent of black color in the above-mentioned binder resin. The coloring agent can be a magnetic powder, a pigment or a dye. Examples of the magnetic powder include surfacially oxidized or unoxidized metal such as iron, nickel, copper, manganese, chromium, a rare earth metal or an alloy thereof, an oxide and ferrite. An example of the pigment is carbon black.

In addition to the above-mentioned components, there may be suitably added a fluidizing agent such as silicon oxide, a grinding agent such as strontium titanate or cerium oxide, a charge control agent etc.

The toner on the sleeve has an average charge amount of 5 to 15 $\mu$C/g and an average coating amount of 0.6 to 0.9 mg/cm$^2$.

Referring to FIG. 1, there are provided a laser driver 81 for on-off driving the semiconductor laser of a wavelength of 655 nm, a laser scanner device 82 composed of a collimating lens, a polygon mirror, an f$\theta$ lens etc. for irradiating the drum surface with the laser beam in synchronization with the rotation of the photosensitive drum and with the image position, image reader means 83 composed of an image pickup device such as CCD and a lens for reading the image information of an original, placed on an unrepresented original table, with a resolution of 600 dpi (dot per inch), read image data process means 84 for effecting shading correction, density conversion, data compression/expansion, binarization etc. on the image read by the image reader means, interface means 85 for connection with an external network for entering control signal from a computer or the like connected to the network and image data signals prepared in such computer or the like, a buffer memory 86 composed for example of a hard disk drive for temporarily storing the image data read by the image reader means and an image entered from the exterior, and a CPU 87 for controlling the entire apparatus. In the present embodiment, the laser driver 81 and the laser scanner device 82 constitute exposure means.

In the following there will be explained the formation of the latent image.

In this embodiment, the smallest pixel size Dpx is selected as 42 $\mu$m (600 dpi) both in the main and sub scanning directions, and the spot diameter is selected according to the experimental result to be explained in the following.

Figure 8:
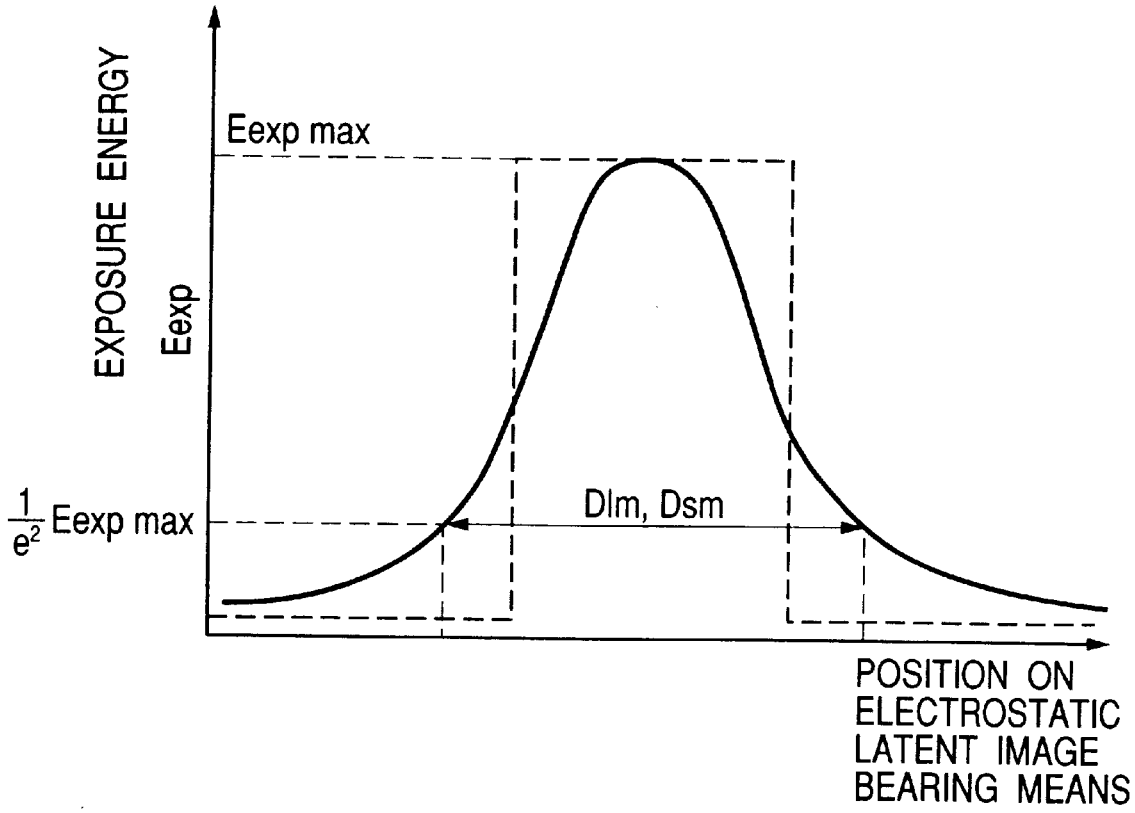
FIG. 8 is a chart showing the energy distribution of a laser beam.
Figure 9:
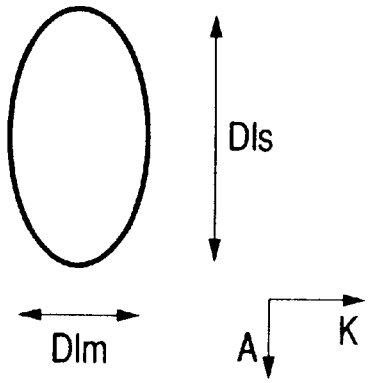
FIG. 9 is a view showing the influence of the spot diameter of the laser beam on the fog.

The spot diameter means the length Dlm along the main scanning direction and the length Dls along the sub scanning direction of an area in which the intensity Eexp of the laser beam, on the electrostatic latent image bearing means in a state where the optical path length of the laser beam is shortest, is at least equal to $1/e^2$ of the highest intensity Eexpmax at the center of the laser beam (FIGS. 8, 9).

Figure 10:
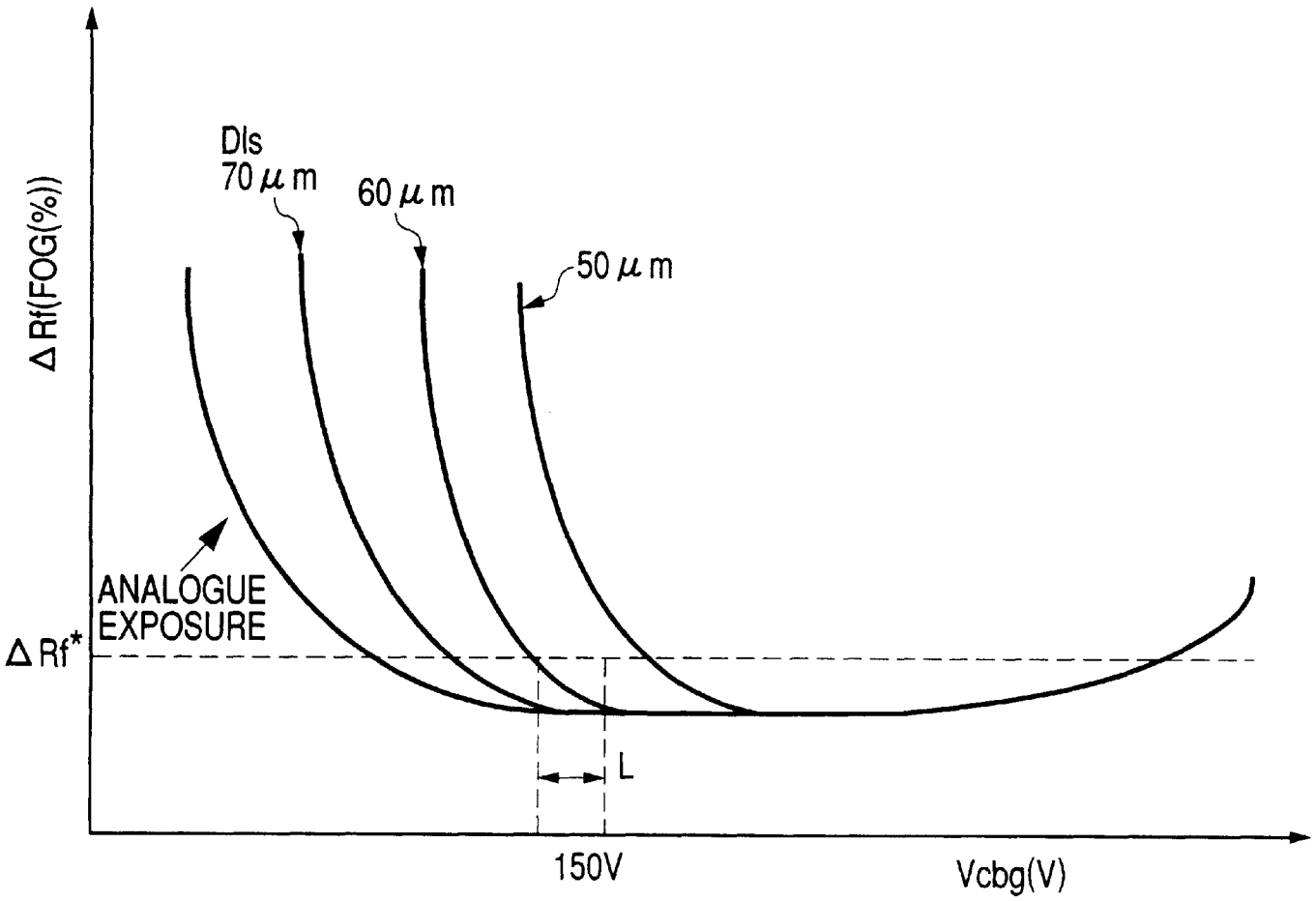
FIG. 10 is a chart showing the relationship between the developing contrast and the image width corresponding to four lines.

FIG. 10 is a chart showing the relationship between Vcbg and the fog (loss percentage of reflectance) $\Delta$Rf, taking the spot diameter Dls in the sub scanning direction as a parameter, wherein $\Delta$Rf* indicates a value of $\Delta$Rf constituting the boundary of acceptable and unacceptable results in the subjective evaluation.

The fog characteristics become closer to those of the analog exposure with the increase in the spot diameter, and, for a same value of Dls, the fog is lowered with the increase in Vcbg. Vd is selected for example as 450 V in consideration of the charging ability of the a-Si photosensitive member, and V1 is selected for example as 50 V in consideration of the power of the light-emitting laser element. Since the developing contrast Vdev (=Vd−Vm) required for reproducibility of a line is about 250 V, Vm is selected as 200 V. Consequently Vcbg becomes about 150 V. Consequently, the spot diameter Dls in the subscanning direction is selected as 60 $\mu$m at minimum, in consideration of the margin L.

On the other hand, the spot diameter Dlm in the main scanning direction, not affecting the fog, is preferably as small as possible in order to improve the line reproducibility, but an excessively small spot diameter is not desirable since it is not balanced with the line width in the subscanning direction.

FIG. 18A shows the spot diameter Dlm in the main scanning direction, the difference $\Delta$W1 between the width of the vertical line and that of the lateral line and the subjective evaluation of the output image at respective spot diameter in the main scanning direction, in case there are selected conditions of V1=50 V, Vcbg=150 V, Vd=450 V and spot diameter Dls in the sub scanning direction of 70 $\mu$m in consideration of the fluctuation in the optical system.

At the resolution of 600 dpi, the image quality is acceptable if the difference between the main and sub scanning directions is about 20 $\mu$m, namely if the difference $\Delta$Ds in the spot diameter is less than about 0.5 times of the minimum pixel size.

Consequently the lower limit of the spot diameter in the main scanning direction is preferably about 50 $\mu$m.

Figure 11:
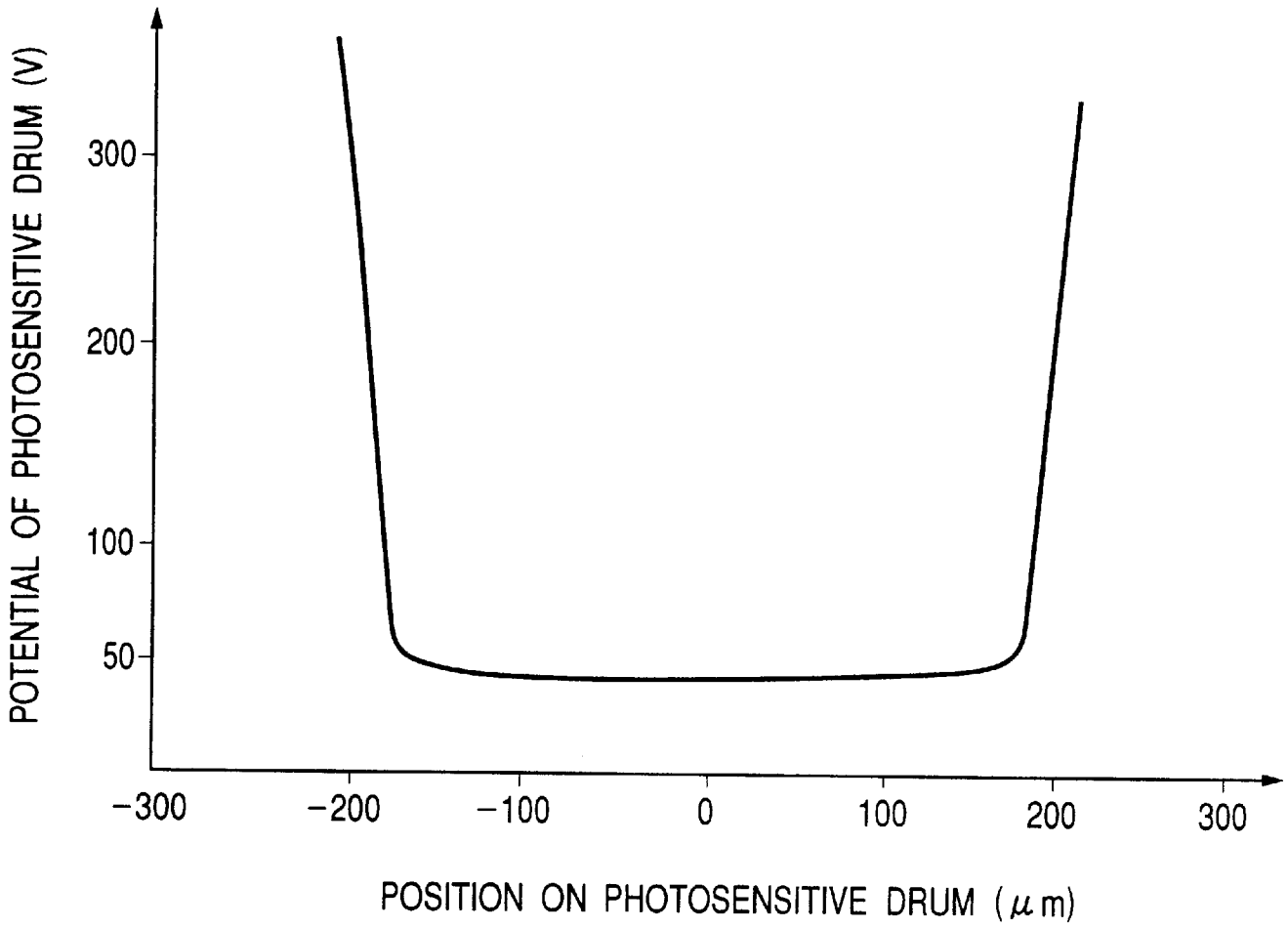
FIG. 11 is a chart showing the potential profile on the photosensitive member when the spot diameter is increased.
Figure 12:
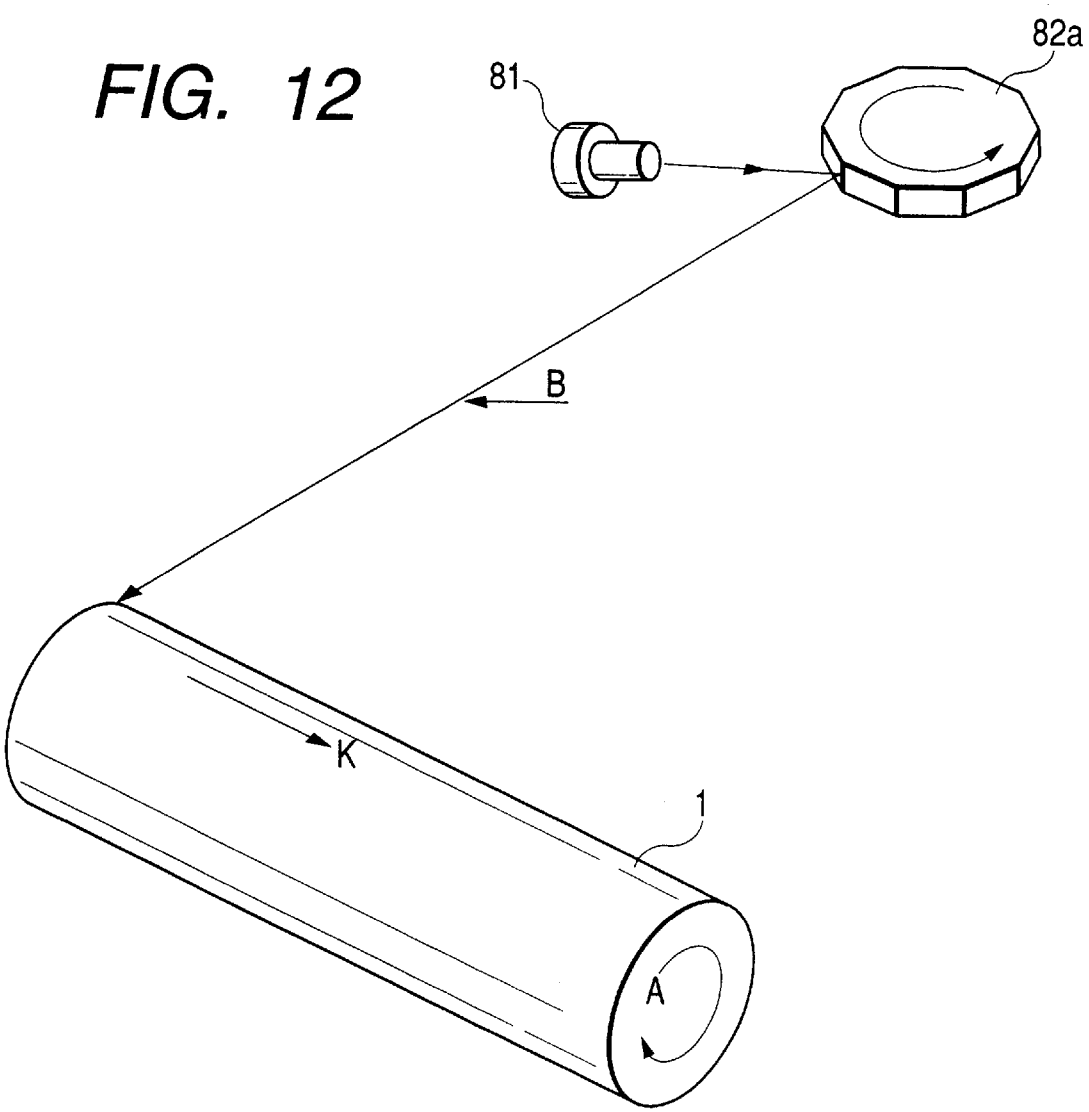
FIG. 12 is a view showing the scanning direction of the laser beam and the rotating direction of the drum-shaped photosensitive member.
Figure 13:
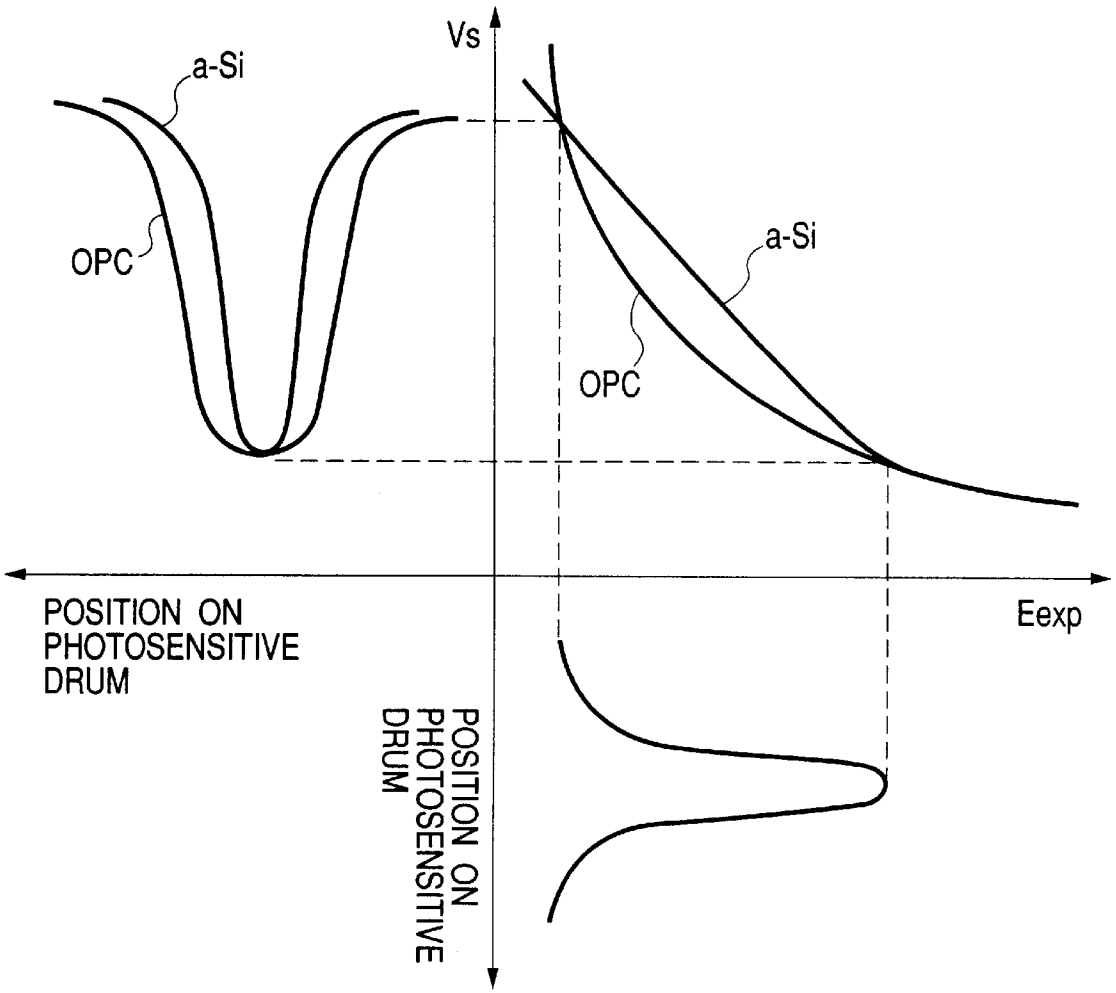
FIG. 13 is a chart showing the difference in characteristics between an OPC photosensitive member and an a-Si photosensitive member.
Figure 14:
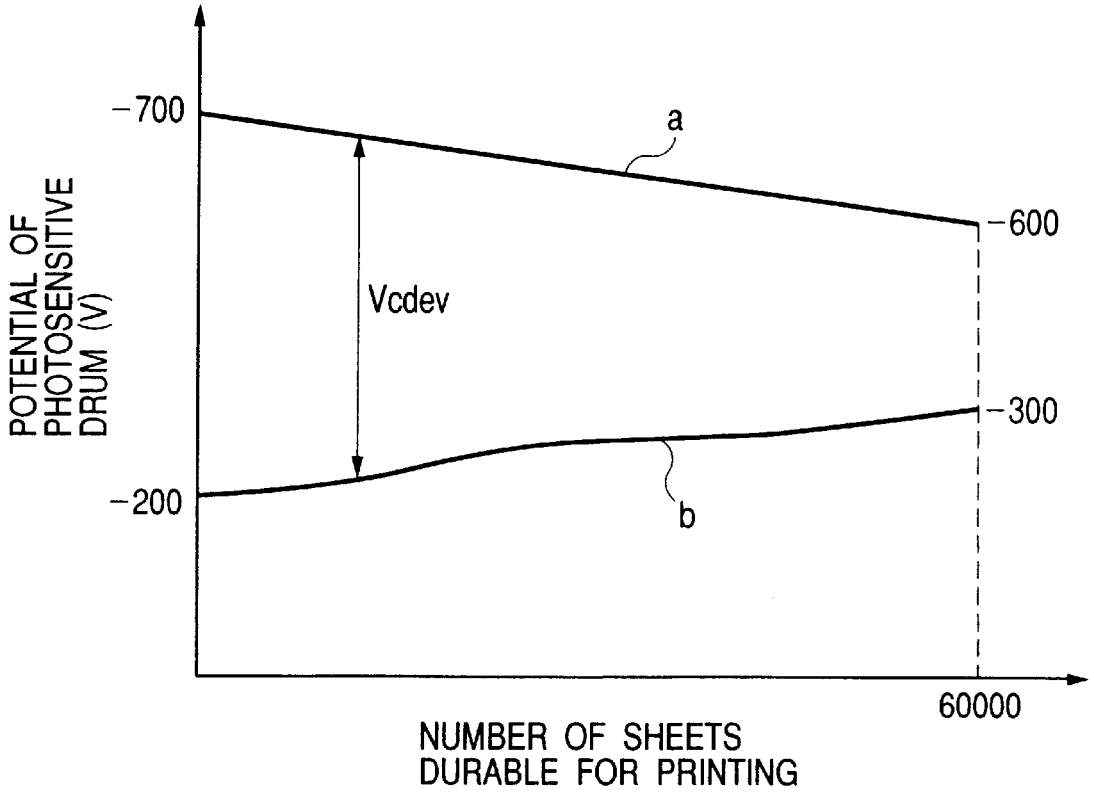
FIG. 14 is a chart showing the deterioration of the OPC photosensitive member with the repetition of printing operation.
Figure 15:
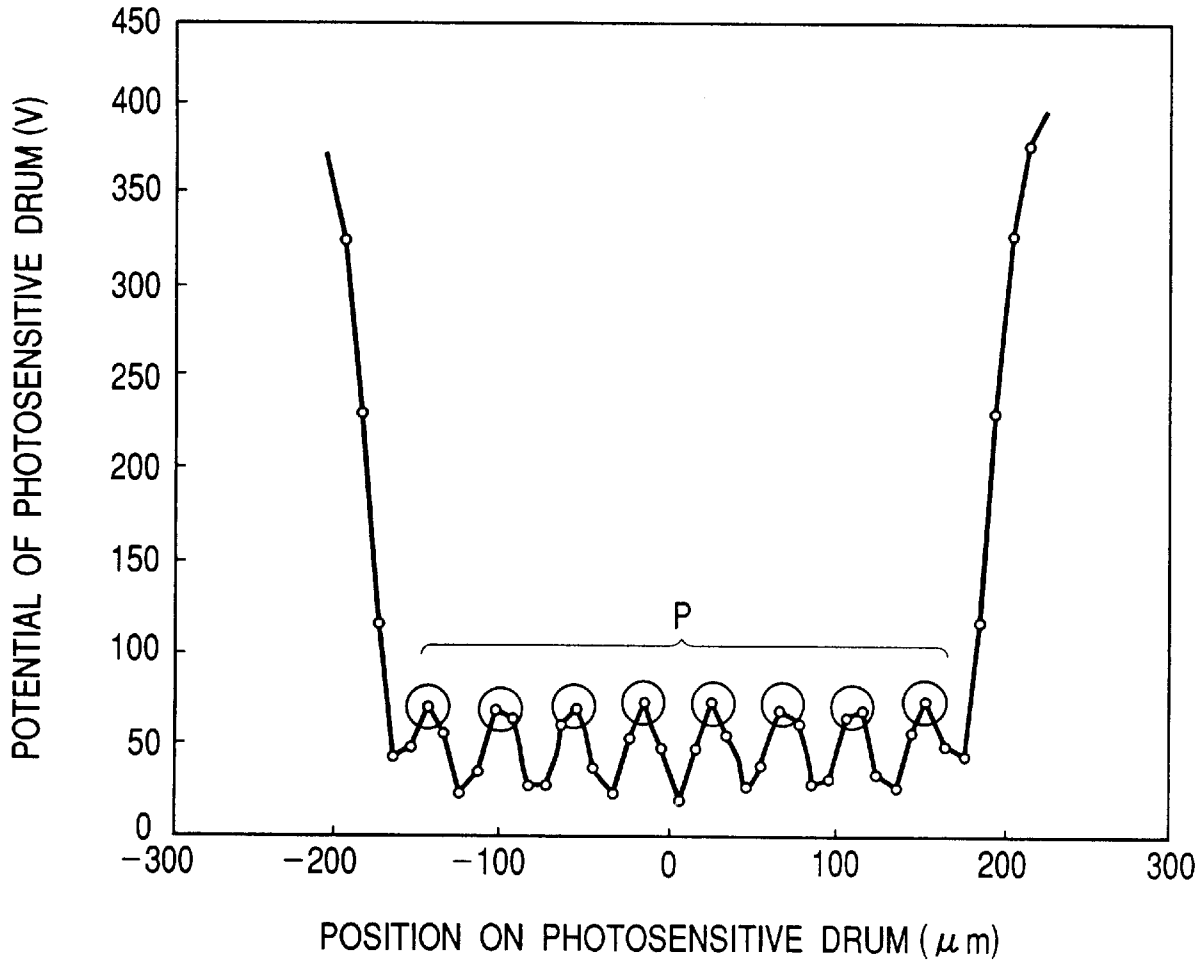
FIG. 15 is a chart showing the potential profile n the photosensitive member when the spot diameter is small.

In this state, the latent image potential of the white image area (V1) on a plane perpendicular to the direction A assumes a form schematically shown in FIG. 11, wherein the laser beam irradiation is executed with a subscanning pitch Dps of 42 $\mu$m and the streaked fog is not generated because the undissipated charge becomes sufficiently small in the overlapping portion of the laser beams.

In the following discussion there will be explained the image forming method under the above-described setting.

The image forming apparatus of the present embodiment is provided not only with the copying function but also with the printer function for outputting the information from an information processing terminal such as a personal computer connected to the network of the information received by facsimile communication.

At first there will be explained the copying function. When an unrepresented copy start button is depressed, the photosensitive drum 1 starts rotation in the direction A by an unrepresented motor, and is charged by the primary charge means 3 to reach the aforementioned potential Vd at the developing position. An unrepresented optical unit, composed of an unrepresented light source and unrepresented mirrors in the image reader means 83, scans the original placed on the unrepresented original table, thereby storing (fetching) the image information of the original as multi-value data of 600 dpi and 256 gradation levels.

Thus stored image data are subjected, in the image data processing circuit 84, to shading correction, density conversion, binarization, compression etc. and are once stored in the hard disk drive 86. Then the image data are read in synchronization with the timing of latent image formation, then subjected to data expansion and supplied to the laser driver circuit 81. The laser driver circuit 81 converts the image data into an on-off laser beam signal so as to turn on the laser beam in the area without the image information, the area between the transfer materials and the marginal area, and to turn off the laser beam in the area containing the image information.

By means of the laser scanner device 82, the laser beam irradiates the photosensitive drum to form a latent image thereon.

In the printer function, the image data are entered into the interface circuit 85, in which the image information signal is converted into bit map data for supply to the image data processing circuit 84. The subsequent operations are the same as those explained above.

The parameters such as the process speed, diameter of the photosensitive drum, developing bias, Vd, V1 etc. are naturally not limited to those of the present embodiment explained in the foregoing.

In the following discussion there will be given a complementary explanation on the physical amounts given in FIGS. 16 to 18B, definitions thereof and measuring methods therefor.

At first a duty ratio η is the ratio of the period T1 in which the developing bias is less than Vm, to the cycle T (FIG. 6).

There are also defined Edev=|Vd−Vdev|/G and Edef+=|Vdef−V1|/G.

A reflective image density RD is the average of the values measured on 5 points, each consisting of a circle of a diameter of 5 mm, on an A4-sized print with the input information of the maximum image density, measured with the densitometer RD-914 of MacBeth Co.

A fog is the average of the values measured on 5 points on an A4-sized print with the input information of the zero image density, measured with the densitometer TC-6DS of Tokyo Denshoku Co., Ltd. and determined as the difference from the reflectance of an unused transfer material which has not passed the interior of the image forming apparatus.

The width of the vertical line means the width of a line formed in the subscanning direction by turning off the laser beam during 4 pixels.

Similarly, the width of the lateral line means the width of a line formed in the main scanning direction by turning off the laser beam during 4 pixels.

There values are the average of the values measured on 10 points on an A4-sized print, with the microdensitometer #2405 of MacBeth Co.

The presence/absence of developing bias leak is judged by the presence/absence of an abnormal image resulting from the developing bias leak, in an environmental testing room adjusted to an atmospheric pressure of about 600 hPa, corresponding to the atmospheric pressure of La Paz, Bolivia (altitude 4071 m), which is considered as the place of lowest atmospheric pressure where such image forming apparatus can be used.

The small area image uniformity is determined by subjective evaluation of the uniformity on the print of circular input information of an intermediate image density of a diameter of 5 mm.

The small pixel image reproducibility is determined by subjective evaluation of the shape on the print of 2×2 pixels arranged in a square.

The relative apparatus cost shows the comparison, taking the cost of the image forming apparatus of the embodiment 1 as unity. According to the investigation of the present applicant, the above-mentioned items can be arranged as the developing bias leak, fog, RD and line width in the descending order of importance.

It is found that the representative users can be satisfied as long as these items are at least at a predetermined level, even if other items are lower than the acceptable level, for example if the difference ΔW1 of the widths of the vertical and lateral lines is large or if the small area image uniformity or the small pixel reproducibility is insufficient.

Embodiments 2 to 12

These embodiments are same as the embodiment 1 except for the developing bias and the gap G, and will not, therefore, be explained in further detail.

The image forming apparatus of these embodiments have the developing biases and the gaps G shown in FIG. 16 and have the performance shown in FIG. 18A.

Embodiments 13 to 19

These embodiments are same as the foregoing ones except for the developing bias, the gap G and the resolution which is 400 dpi with a pixel size of 64 μm×64 μm, and will not, therefore, be explained in further detail.

The image forming apparatus of these embodiments have the developing biases and the gaps G shown in FIG. 16 and have the performance shown in FIG. 18A.

As already known, the cost of the image forming apparatus is lower in comparison with that of the image forming apparatus with the resolution of 600 dpi.

The embodiments 13, 14, 18 and 19 do not satisfy the conditions Dls≧1.4 Dps and ΔDs<0.5 Dpx and are inferior in ΔW1 and the small pixel reproducibility to other embodiments satisfying these conditions but are superior to the comparative examples.

Embodiments 20 to 24

These embodiments are same as the embodiment 1 except for the developing bias and the gap G, and will not, therefore, be explained in further detailed.

The image forming apparatus of these embodiments have the developing biases and the gaps G shown in FIG. 16 and have the performance shown in FIG. 18A.

The fog level is somewhat elevated and the width of the line image is somewhat decreased because the portion T2 of the developing bias is less steep and the sleeve diameter is reduced to 24.5 mm, but the image forming apparatus is made more compact and lower in the manufacturing cost.

Embodiment 25

This embodiment is same as the embodiment 1 except that the image exposure time Texppx per pixel is varied in 256 levels, and will not, therefore, be explained in further detail.

The configuration and function of the pulse width modulation (PWM) circuit 9 for varying the above-mentioned exposure time Texppx are already known and will not be explained in further detail.

In the image forming apparatus of the present embodiment, the aforementioned streaked fog was conspicuous (quantitatively 2.5%).

Embodiment 26

This embodiment is same as the embodiment 1 except that the developing sleeve 42 is composed solely of a stainless alloy (SUS304) subjected to a surface roughing treatment by glass powder blasting and is not provided with the surface layer, and will not, therefore, be explained in further detail.

In the image forming apparatus equipped with the a-Si photosensitive member, a heating member 9 such as a planar heater is provided along the internal periphery of the photosensitive drum in order to prevent so-called smeared image (image perturbation resulting from the decrease in the surfacial resistance, caused by the moisture absorption on the surface of the photosensitive member for example under a high-temperature, high-humidity environment), and such heating member is commonly energized even at night when the image forming apparatus is not in use.

In such situation, a side of the similarly stopped developing sleeve 42, opposed to the photosensitive drum 1, assumes a higher temperature, whereby the developing sleeve 42 of stainless alloy lower in thermal conductivity than aluminum alloy tends to show image unevenness at the pitch of periphery of the developing sleeve, resulting from the temperature distribution thereof.

Comparative Examples 1 to 18

These embodiments are same as the embodiment 1 except for the developing bias and the gap G, and will not, therefore, be explained in further detail.

The image forming apparatus of these examples have the developing biases and the gaps G shown in FIG. 17 and have the performance shown in FIG. 18B. The image forming apparatus embodying the present invention are evidently superior.

The present invention has been explained by embodiments in which the present invention is applied to the monochromatic multifunction image forming apparatus employing magnetic one-component developer, but the present invention is not limited to such embodiments and is likewise applicable for example to a copying apparatus having the copying function only, a printer having the printing function only or a facsimile apparatus having the facsimile function only.

Also the image forming apparatus equipped with the developing means having an electrostatic latent image bearing means and two or more toner bearing members, the developing means of a type in contact with the developer bearing means as the toner regulating means, or the developing means in which the toner bearing member and magnetic field generating means incorporated in the toner bearing member rotate together, or the image forming apparatus equipped with two or more electrostatic latent image bearing means and belt-shaped electrostatic latent image bearing means, namely any modification considered minor in the concept of the present invention is naturally included within the scope of the present invention.

As explained in the foregoing, the embodiments of the present invention can provide a developing apparatus and an image forming apparatus capable of suppressing the fog, preventing thinning of the image line and providing the stable image over a prolonged period.

Also the use of electrostatic latent image bearing image having the photoconductive layer containing a least amorphous silicon allows to increase the image output speed and to reduce the cost per print.

What is claimed is:

1. A developing apparatus comprising:

a developer bearing member for bearing developer; and voltage application means for applying a voltage to said developer bearing member, said voltage application means being adapted to apply a voltage varying with a cycle T between a first voltage value for separating the developer from said developer bearing member and a second voltage value for returning the developer to said developer bearing member;

wherein a transition time T1 from the first voltage value to the second voltage value and a transition time T2 from the second voltage value to the first voltage value satisfy:

$0.3T<T1<0.5T$ and $T2<0.1T$; and wherein said developing apparatus is provided to a latent image bearing means with a gap G ($\mu$m), and a potential V1 (V) in an exposed area of said latent image bearing means, a potential Vd (V) of an unexposed area thereof, the first voltage value Vdev (V) and the second voltage value Vdef (V) satisfy:

$3.7\ V/\mu m<|Vd-Vdev|/G<5.2\ V/\mu m$ and $2.2\ V/\mu m<|Vdef-V1|/G<5.2\ V/\mu m$.

2. A developing apparatus according to claim 1, wherein the gap G is not less than 140 $\mu$m and not more than 200 $\mu$m.

3. A developing apparatus according to claim 1, wherein the cycle T is not less than 250 $\mu$s and not more than 600 $\mu$s.

4. A developing apparatus according to claim 1, wherein a difference between the first voltage value Vdev and the second voltage value Vdef is not more than 2000 V.

5. A developing apparatus according to claim 1, wherein a size Dls in a subscanning direction of a light spot for exposing said latent image bearing means is equal to or larger than 1.4 times of a scanning pitch Dps in the subscanning direction, and a difference $\Delta$ Ds between a size Dms of the light spot in a main scanning direction and a size Dls in the sub scanning direction is less than 0.5 times of a pixel size Dpx.

6. A developing apparatus according to claim 5, wherein the exposure of said pixel is executed based on binarized image information.

7. A developing apparatus according to claim 1, wherein said developer bearing member includes an aluminum alloy and a resinous material covering the aluminum alloy and containing conductive particles.

8. A developing apparatus according to claim 1, wherein said latent image bearing means includes a photoconductive layer containing at least amorphous silicon.

9. A developing apparatus according to claim 1, wherein the developer is a magnetic, one-component toner.

10. An image forming apparatus comprising:

a latent image bearing member for bearing a latent image;

a developer bearing member provided to said latent image bearing member with a gap and adapted for bearing developer; and voltage application means for applying a voltage to said developer bearing member, said voltage application means being adapted to apply a voltage varying with a cycle T between a first voltage value for separating the developer from said developer bearing member and a second voltage value for returning the developer to said developer bearing member;

wherein a transition time T1 from the first voltage value to the second voltage value and a transition time T2 from the second voltage value to the first voltage value satisfy:

$0.3T<T1<0.5T$ and $T2<0.1T$; and wherein a gap G ($\mu$m) between said latent image bearing member and said developer bearin member, a potential V1 (V) in an exposed area of said latent image bearing member, a potential Vd (V) of an unexposed area thereof, the first voltage value Vdev (V) and the second voltage value Vdef (V) satify:

$3.7\ V/\mu m<|Vd-Vdev|/G<5.2\ V/\mu m$ and $2.2\ V/\mu m<|Vdef-V1|/G<5.2\ V/\mu m$.

11. An image forming apparatus according to claim 10, wherein the gap G is not less than 140 $\mu$m and not more than 200 $\mu$m.

12. An image forming apparatus according to claim 10, wherein the cycle T is not less than 250 $\mu$s and not more than 600 $\mu$s.

13. An image forming apparatus according to claim 10, wherein the difference between the first voltage value Vdev and the second voltage value Vdef is not more than 2000 V.

14. An image forming apparatus according to claim 10, wherein the size Dls in a subscanning direction of a light spot for exposing said latent image bearing means is equal to or larger than 1.4 times of a scanning pitch Dps in the subscanning direction, and a difference ΔDs between a size Dms of the light spot in a main scanning direction and a size Dls in the subscanning direction is less than 0.5 times of a pixel size Dpx.

15. An image forming apparatus according to claim 14, wherein the exposure of said pixel is executed based on binarized image information.

16. An image forming apparatus according to claim 10, wherein said developer bearing member includes an aluminum alloy and a resinous material covering the aluminum alloy and containing conductive particles.

17. An image forming apparatus according to claim 10, wherein said latent image bearing means includes a photoconductive layer containing at least amorphous silicon.

18. An image forming apparatus according to claim 10, wherein the developer is a magnetic, one-component toner.

* * * * *

UNITED STATES PATENT AND TRADEMARK OFFICE

CERTIFICATE OF CORRECTION

PATENT NO. : 6,282,393 B1
APPLICATION NO. : 09/487316
DATED : August 28, 2001
INVENTOR(S) : Hideki Fujita It is certified that error appears in the above-identified patent and that said Letters Patent is hereby corrected as shown below:

COLUMN 2:

Line 23, “small.” should read --smell.--.

COLUMN 3:

Line 1, “printers etc.” should read --printers, etc.,--;
Line 18, “in” should read --with--; and
Line 42, “cannot” should be deleted.

COLUMN 5:

Line 7, “n” should read --on--;
Line 10, “bias etc.” should read --bias, etc.,--; and
Line 12, “bias etc.” should read --bias, etc.,--.

COLUMN 7:

Line 63, “less” should read --as less--.

COLUMN 8:

Line 67, “resin” should read --resin,--.

COLUMN 9:

Line 12, “agent” should read --agent,--;
Line 19, “lens etc.” should read --lens, etc.,--; and
Line 28, “binarization etc.” should read --binarization, etc.,--.

COLUMN 10:

Line 13, “diameter” should read --diameters--; and
Line 53, “compression etc.” should read --compression, etc.--.

COLUMN 11:

Line 5, “V1 etc.” should read --V1, etc.,--.

UNITED STATES PATENT AND TRADEMARK OFFICE

CERTIFICATE OF CORRECTION

PATENT NO. : 6,282,393 B1
APPLICATION NO. : 09/487316
DATED : August 28, 2001
INVENTOR(S) : Hideki Fujita It is certified that error appears in the above-identified patent and that said Letters Patent is hereby corrected as shown below:

COLUMN 13:

Line 44, “image” (second occurrence) should read --means--; and
Line 66, “and” should be deleted.

COLUMN 14:

Line 15, “of a” should read --the--;
Line 18, “sub scanning” should read --subscanning--; and
Line 57, “bearin” should read --bearing--.

COLUMN 15:

Line 4, “of a” should read --the--; and
Line 7, “of a” should read --the--.

Signed and Sealed this

Nineteenth Day of February, 2008

JON W. DUDAS
*Director of the United States Patent and Trademark Office*